US012714218B2

(12) United States Patent
Siegel

(10) Patent No.: US 12,714,218 B2
(45) Date of Patent: Aug. 25, 2026

(54) BACKCOUNTRY BACKPACK WITH TOOL STORAGE APPARATUS

(71) Applicant: Raide Inc., Boulder, CO (US)

(72) Inventor: Kyle Siegel, Carbondale, CO (US)

(73) Assignee: Raide, Inc., Boulder, CO (US)

( * ) Notice: Subject to any disclaimer, the term of this patent is extended or adjusted under 35 U.S.C. 154(b) by 353 days.

(21) Appl. No.: 18/444,949

(22) Filed: Feb. 19, 2024

(65) Prior Publication Data

US 2025/0261745 A1 Aug. 21, 2025

(51) Int. Cl.

| | |
|---|---|
| ***A45F 3/04*** | (2006.01) |
| ***A45F 3/00*** | (2006.01) |
| ***A45F 3/12*** | (2006.01) |

(52) U.S. Cl.

CPC ..... *A45F 3/047* (2013.01); *A45F 2003/003* (2013.01); *A45F 2003/045* (2013.01); *A45F 2003/127* (2013.01)

(58) Field of Classification Search

CPC ..... A45F 3/047; A45F 2003/003
USPC ..... 224/637, 153, 627, 259
See application file for complete search history.

(56) References Cited

U.S. PATENT DOCUMENTS

| | | | | | |
|---|---|---|---|---|---|
| 2,394,332 | A * | 2/1946 | Salem | A45C 13/40 | 150/123 |
| 3,117,607 | A * | 1/1964 | Siegel | A45C 9/00 | 383/113 |
| 4,171,011 | A * | 10/1979 | Kopin | A45C 13/40 | 190/102 |
| 4,236,615 | A * | 12/1980 | Ginat | A45C 7/0068 | 383/41 |
| 4,830,154 | A * | 5/1989 | Gerch | A45C 3/00 | 190/111 |
| 6,116,045 | A * | 9/2000 | Hodosh | F25D 3/08 | 62/457.7 |
| 9,420,859 | B2 * | 8/2016 | Bourette | A45C 7/0068 | |
| 10,080,411 | B2 * | 9/2018 | Deioma | A45F 3/04 | |
| 11,000,108 | B1 * | 5/2021 | Jusic | A45F 3/04 | |
| 11,690,436 | B2 * | 7/2023 | Jusic | A45F 3/04 | 224/655 |
| D1,023,566 | S * | 4/2024 | Park | D3/217 | |
| 2005/0133399 | A1 * | 6/2005 | Fidrych | A45F 3/04 | 206/545 |
| 2007/0289199 | A1 * | 12/2007 | Looney | A01K 97/04 | 220/920 |
| 2023/0121622 | A1 * | 4/2023 | Roy | A45F 3/14 | 224/446 |

* cited by examiner

*Primary Examiner* — Nathan J Newhouse
*Assistant Examiner* — Lester L Vanterpool
(74) *Attorney, Agent, or Firm* — Galvani Smith PLLC

(57) ABSTRACT

An ultralight backcountry backpack may include at least one shoulder strap connected to a pack body. The pack body may include a back wall configured to interface with a user's back when the backpack is worn, a front wall distal to the back wall, and a perimeter wall connecting the back and front walls. The back, front, and perimeter walls may define an interior storage compartment. The perimeter wall may include an upper region and a basal region. The basal region may comprise a probe zipper, a shovel blade zipper, and a shovel rod zipper. The backpack may include a tool storage apparatus comprising a probe sleeve, a shovel blade sleeve, and a shovel rod sleeve. Each sleeve may be configured to be accessible at the basal region by opening and closing the corresponding zipper.

20 Claims, 39 Drawing Sheets

BACKCOUNTRY BACKPACK WITH TOOL STORAGE APPARATUS

TECHNICAL FIELD

The present disclosure relates generally to outdoor gear for mountaineering, skiing, and snowboarding, specifically, a versatile backcountry backpack having a tool storage apparatus.

BACKGROUND

The backcountry, a remote undeveloped wilderness beyond your typical ski resort boundaries, can be treacherous for mountaineers, skiers, snowboarders, and adventurers alike. Whether scaling vast New Zealand peaks, setting uphill skin tracks in undisturbed Canadian mountain passes, or snowboarding down backcountry slopes near a popular Colorado ski resort, navigating the varied and ever-changing environmental conditions of raw wilderness requires trustworthy gear.

For every adventurer, few pieces are more important than the backcountry backpack. The backpack is a critical backcountry staple, necessary for accomplishing one's objectives in the backcountry, be it securing skis and snowboards or storing emergency tools of many kinds. Avalanches are an acute danger in the backcountry and adventurers prepare for avalanches by carrying avalanche rescue tools in their backpacks. Regrettably, today's backpacks lack the versatility needed to fulfill many backcountry objectives and fall short in meeting the moment when disaster strikes. Critically, many packs fail to make tools easily accessible.

Current backcountry backpacks are often too heavy, made of materials inadequate for withstanding regular use and environmental stressors, are improperly compartmentalized, and give users poor access to the tools they require on a moment's notice. Backpack storage systems should improve safety and maximize tool accessibility when exploring the great outdoors.

SUMMARY

A backcountry backpack and a tool storage system is disclosed herein, in accordance with various embodiments.

In some aspects, an ultralight backcountry backpack is disclosed herein. The ultralight backcountry backpack may include at least one shoulder strap connected to a pack body. The pack body may include a back wall. The back wall may interface with a user's back when the backpack is worn. The back wall may include a wall zipper.

The pack body may also include a front wall that is distal to the back wall and a perimeter wall connecting the back and front walls. Together, the back, front, and perimeter walls may define an interior storage compartment. The perimeter wall may include an upper region and a basal region. The basal region may include a probe zipper, a shovel blade zipper, and a shovel rod zipper. Each of the probe zipper, shovel blade zipper, and shovel rod zipper may allow a user to access the tool storage apparatus without the need for taking off the ultralight backcountry backpack.

The backpack may further include a tool storage apparatus within the interior storage compartment. The tool storage apparatus may include a probe sleeve, a shovel blade sleeve, and a shovel rod sleeve. Each of the probe, shovel blade, and shovel rod sleeves may be accessible at the basal region by opening and closing the corresponding probe, shovel blade, and shovel rod zippers.

A backpack is also disclosed herein, in accordance with various embodiments. The backpack may include at least one shoulder strap connected to a pack body. The pack body may include a first wall, which may interface with a user's back when the backpack is worn. The first wall may include a wall zipper.

The pack body may further include a second wall that is distal to the first wall, and a third wall connecting the first and second walls. The third wall may include an upper region, a basal region, a first lateral region, and a second lateral region ("first lateral wall" and "second lateral wall" may be used interchangeably to describe the first lateral region and second lateral region, respectively).

The pack body may further comprise a first lateral region zipper located proximately between the basal region and first lateral region, and a base zipper located proximately between the second wall and the basal region of the third wall. The pack body may define an interior volume. In various embodiments, interior surfaces of the first, second, and third walls may define a storage apparatus within the interior volume. Each of the first lateral region zipper and the base zipper may allow a user to access the storage apparatus without taking off the backpack.

A backpack is disclosed herein, in accordance with various embodiments. The backpack may include at least one shoulder strap connected to a pack body. The pack body may include a first wall. The first wall may interface with a user's back when the backpack is worn. The first wall may include a wall zipper.

The pack body may further include a second wall that is distal to the first wall, and a third wall connecting the first and second walls. Together, the first, second, and third walls may define an interior volume. The third wall may include an upper region and a basal region. The basal region may include a first basal zipper, a second basal zipper, and third basal zipper.

The backpack may further include a storage apparatus within the interior volume. The storage apparatus may include a first sleeve, a second sleeve, and a third sleeve. Each of the first, second, and third sleeves may be accessible at the basal region by opening and closing the corresponding first, second, and third zippers. Each of the first, second, and third zippers may allow a user to access the storage apparatus without taking off the backpack.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter of the application and uses of such embodiments. As used herein, the words "exemplary" and "example" mean "serving as an example, instance, or illustration." Any implementation or embodiment described herein as exemplary, or an example is not necessarily to be construed as preferred or advantageous over other implementations. Furthermore, there is no intention to be bound by any expressed or implied theory presented in the preceding technical field, background, or the following detailed description.

An ultralight backcountry backpack is disclosed herein, in accordance with various embodiments. The ultralight backcountry backpack may include at least one shoulder strap connected to a pack body. In various embodiments, the pack body may include a back wall that may interface with a user's back when the backpack is worn. The back wall may include a back wall zipper. The pack body may also include a front wall that is distal to the back wall and a perimeter wall connecting the back and front walls. Together, the back, front, and perimeter walls may define an interior storage compartment. The perimeter wall may include an upper region and a basal region. The basal region may include a probe zipper, a shovel blade zipper, and a shovel rod zipper.

The ultralight backcountry backpack may further include a tool storage apparatus within the interior storage compartment. The tool storage apparatus may include a probe sleeve, a shovel blade sleeve, and a shovel rod sleeve. Each of the probe, shovel blade, and shovel rod sleeves may be accessible at the basal region by opening and closing the corresponding probe, shovel blade, and shovel rod zippers.

A backpack is also disclosed herein, in accordance with various embodiments. The backpack may include at least one shoulder strap connected to a pack body. The pack body may include a first wall. The first wall may interface with a user's back when the backpack is worn, and may include a first wall zipper. The pack body may further include a second wall that is distal to the first wall, and a third wall connecting the first and second walls. Together, the first, second, and third walls may define an interior volume. The third wall may include an upper region and a basal region. The basal region may include a first basal zipper, a second basal zipper, and third basal zipper.

The backpack may further include a storage apparatus within the interior volume. The storage apparatus may include a first sleeve, a second sleeve, and a third sleeve. Each of the first, second, and third sleeves may be accessible at the basal region by opening and closing the corresponding first, second, and third basal zippers.

FIGS. 1 through 5 illustrate perspective views of a backpack, in accordance with various embodiments.

Figure 1:
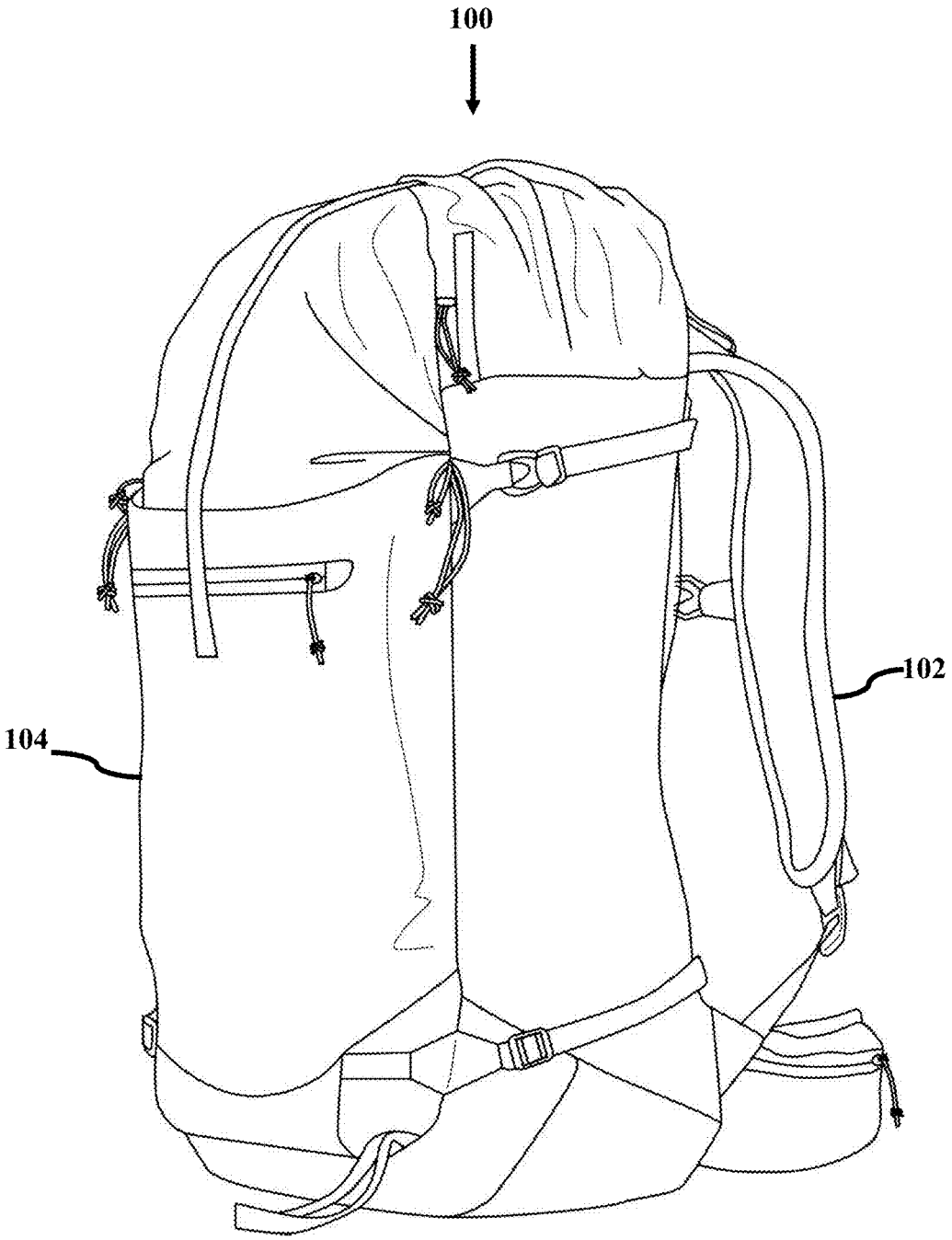
FIG. 1 illustrates a perspective view of a backpack, in accordance with various embodiments.
Figure 2:
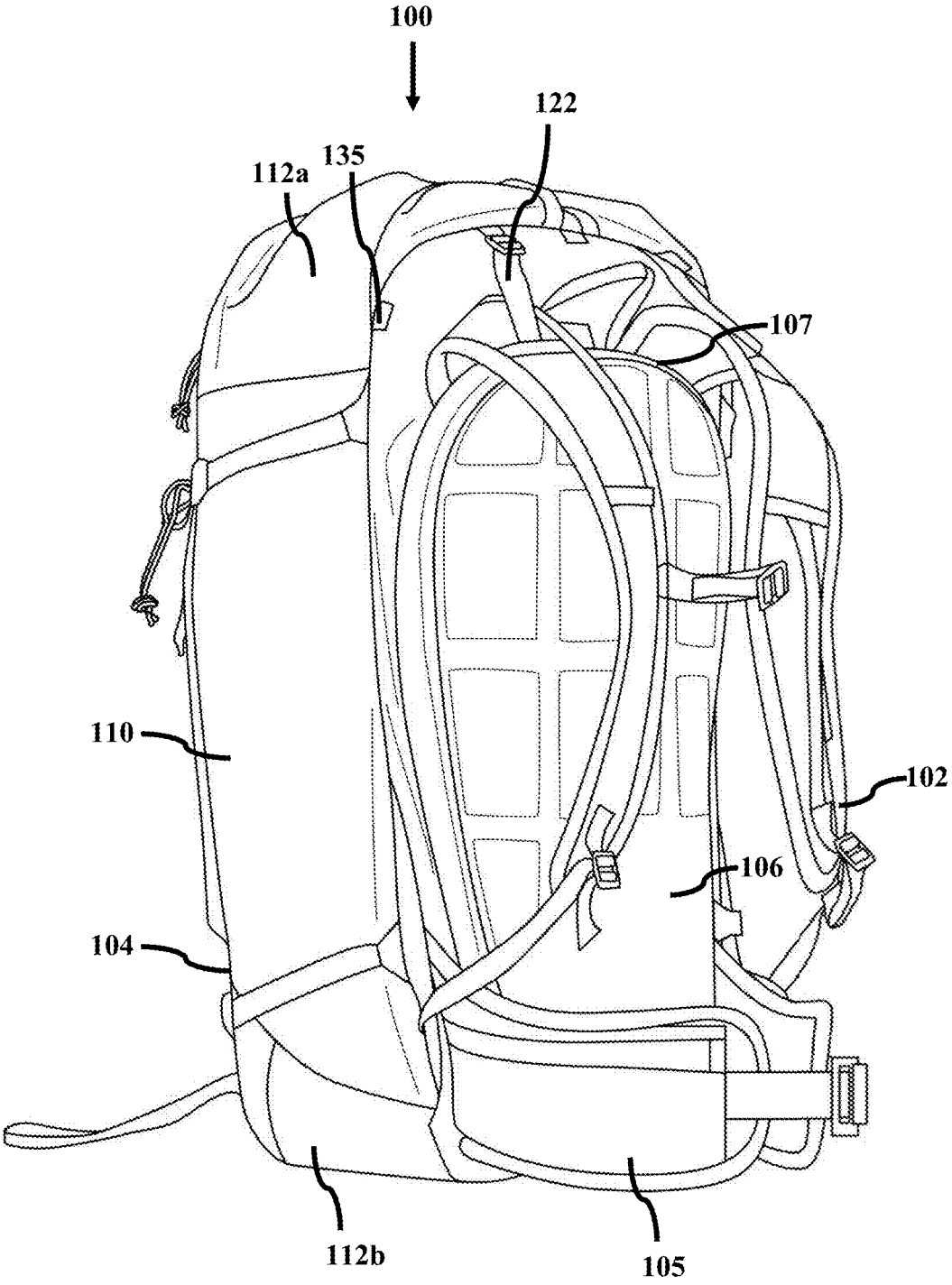
FIG. 2 illustrates a perspective view of the backpack, in accordance with various embodiments.

As shown in FIGS. 1 and 2, the backpack 100 may include at least one shoulder strap 102 connected to a pack body 104. In some aspects, the pack body 104 may include a first wall 106. In various embodiments, the first wall 106 may include a wall zipper 107 that enables user access to contents (e.g., gear) stowed in the pack body 104. In various embodiments, the first wall 106 of the pack body 104 may interface with a user's back when the backpack is worn. Moreover, as shown in FIGS. 1 and 2, the shoulder strap 102 may be connected to the pack body 104 at the first wall 106. In some aspects, the shoulder strap 102 may include at least one adjustable load lifter strap 122 proximal an upper region 112*a* of the pack body 104. In various embodiments, the adjustable load lifter strap 122 may further connect the shoulder strap 102 to the first wall 106, stabilizing the backpack 100 when used. In various embodiments, the adjustable load lifter strap 122 may shift and/or disperse the load (e.g., weight) from the user's shoulder by lifting part of the load off the user's shoulder when the backpack 100 is worn, increasing comfort to the user, decreasing user fatigue, and improving stability.

In various embodiments, the pack body 104 may include at least one hip pad 105. The hip pad 105 may further increase stability to the user when carrying the backpack 100 by transferring the weight of the backpack 100, shifting part of the load from the user's shoulder to the user's hips. In doing so, the hip pad 105 may allow a user's legs (which are generally stronger than a user's shoulders) to bear much of the backpack's weight. In various embodiments, the hip pad 105 may be padded. In other embodiments, the hip pad 105 may be webbed.

In various embodiments, the pack body 104 may allow a user to store gear and other items. In one exemplary embodiment, the pack body 104 may be large enough to accommodate multiple pieces of gear at once, such as for example, long probe(s), shovel(s), snow glove(s), radio(s), rope(s), snack(s), a helmet, a hydration bladder, an air supply apparatus, and the like.

Moreover, referring to FIGS. 1-4, the pack body 104 may further include a second wall 108 that is distal to the first wall 106. In various embodiments, the pack body 104 may further include a third wall 110 connecting the first wall 106 and second wall 108. As shown in FIG. 2, the third wall 110 may include an upper region 112*a* and a basal region 112*b*. In various embodiments, when the backpack 100 is being worn by a user, the upper region 112*a* of the third wall 110 may be proximal the user's upper back, neck, and head region.

Figure 3:
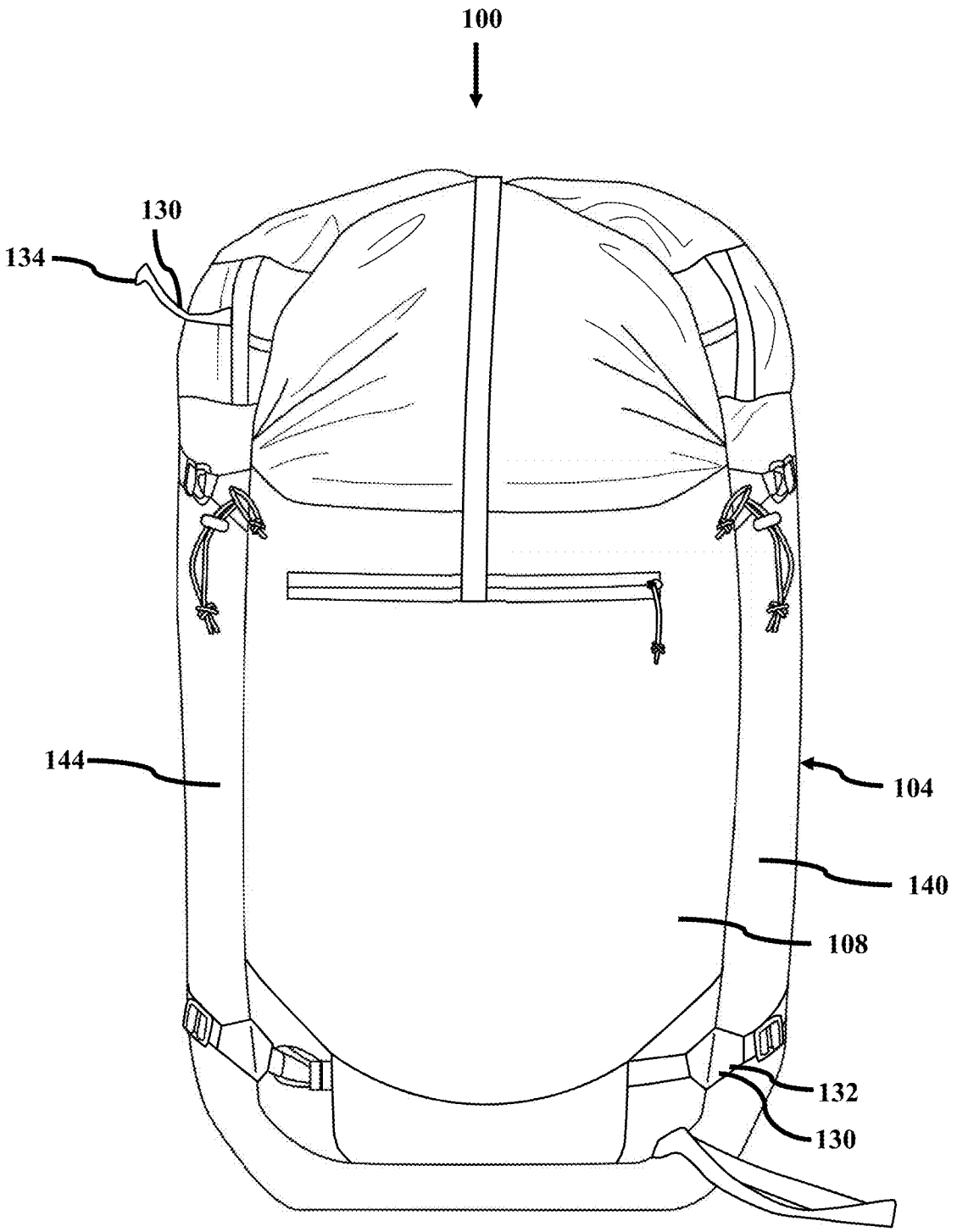
FIG. 3 illustrates a perspective view of the backpack, in accordance with various embodiments.

Likewise, when the backpack 100 is being worn by the user, the basal region 112*b* of the third wall 110 may be proximal the user's lower back, tailbone, and leg region. In various embodiments, the third wall 110 may further include at least one lateral region. For example, as shown in FIG. 3, the third wall 110 may include a first lateral region 140 and a second lateral region 144. In various embodiments, the first lateral region 140 may be distal the second lateral region 144. Accordingly, in various embodiments, the third wall 110 connecting the first wall 106 and second wall 108 may include upper 112*a*, basal 112*b*, first lateral 140, and second lateral 144 regions.

Figure 4:
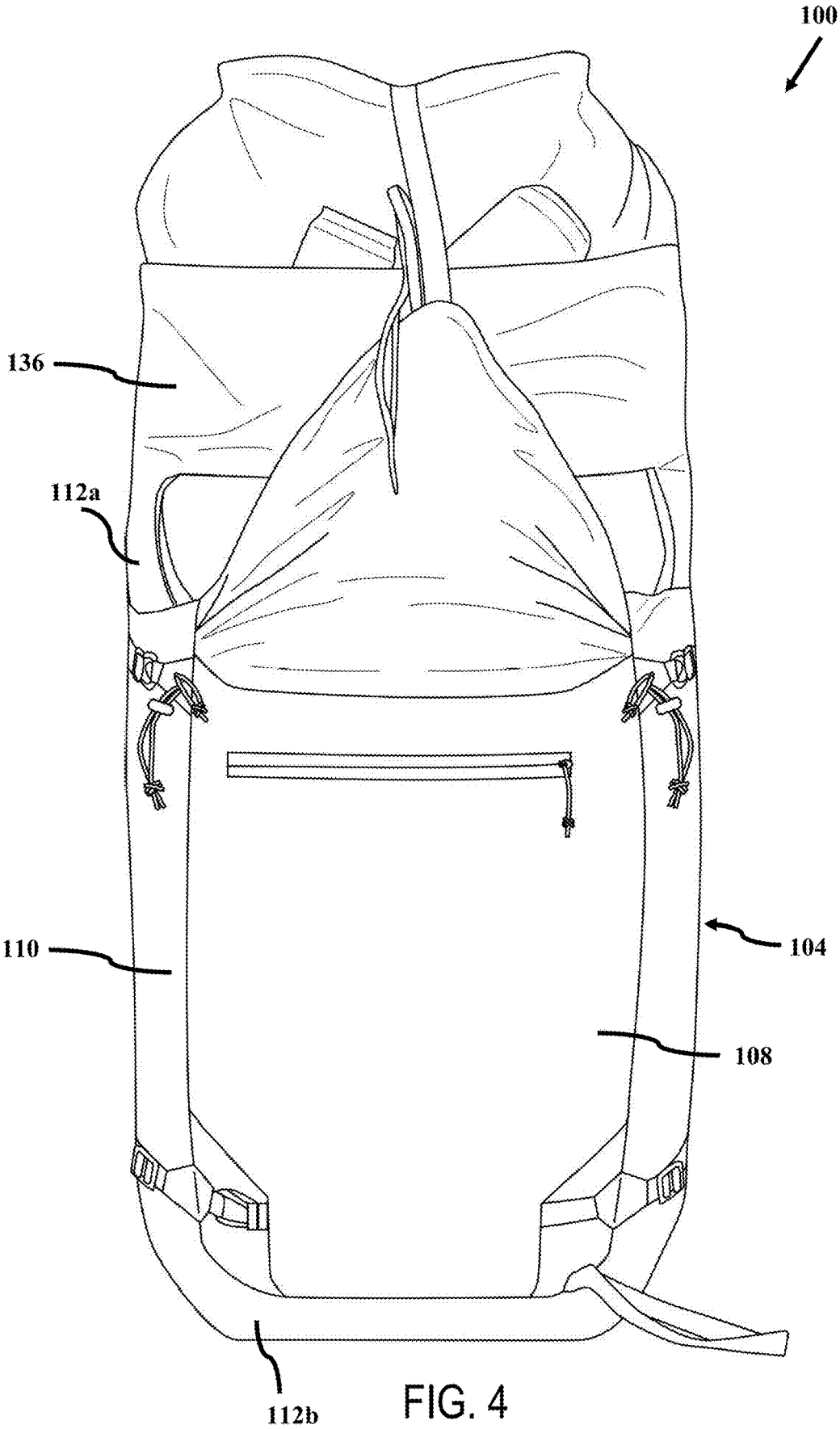
FIG. 4 illustrates a perspective view of the backpack, in accordance with various embodiments.

In various embodiments, as shown in FIG. 4, the upper region 112*a* of the third wall 110 may define an expandable opening 136. In various embodiments, the expandable opening 136 may be an expandable cinch opening, drawstring opening, roll top opening, and/or the like. In various embodiments, expandability of the upper region 112*a* of the third wall 110 may be advantageous, allowing for storage of items for any kind of outdoor objective, and for any purpose. In various embodiments, expandability of the upper region 112*a* of the third wall 110 may be advantageous, allowing for storage of bulky gear items, such as helmets, beverages, sleeping bags, and the like. In various embodiments, the third wall 110 defining the expandable opening 136 may enable access to contents stored within the pack body 104.

As shown in FIGS. 2 and 3, in various embodiments, the pack body 104 may further include a vertical snowboard carry system 130. As shown, the vertical snowboard carry system 130 may include a first strap 132 attached at the second wall 108 proximal the basal region 112*b* of the third wall 110. In various embodiments, the first strap 132 may further include a fastening means for removably coupling to a corresponding member at the second wall 108 proximal the basal region 112*b* of the third wall 110. In various embodiments, the corresponding member may be at the second wall 108 proximal the basal region 112*b* of the third wall 110 and horizontally distal the first strap 132. In various embodiments, the fastening means and corresponding member may be a clasp, buckle, clip, catch, hook, tie, pin lock, and the like.

In various embodiments, the vertical snowboard carry system 130 may further include a and a second strap 134 diagonally distal the first strap 132 and attached at the upper region 112*a* of the third wall 110. In various embodiments, the second strap 134 may be removably coupled to a band 135 attached at the first wall 106 proximal the upper region 112*a* of the third wall 110. Together, the first strap 132 and second strap 134 may be wrapped around a snowboard and removable coupled to the corresponding member and the band 135, respectively.

Accordingly, in various embodiments, the vertical snowboard carry system may allow a snowboard to be removably secured to the backpack 100. Therefore, in some aspects, the second wall 108 of the pack body 104 may interface with a snowboard. In various embodiments, the snowboard carry system disclosed herein may secure a snowboard to the backpack 100 in any desirable orientation, be it vertical, diagonal, or horizontal.

Figure 5A:
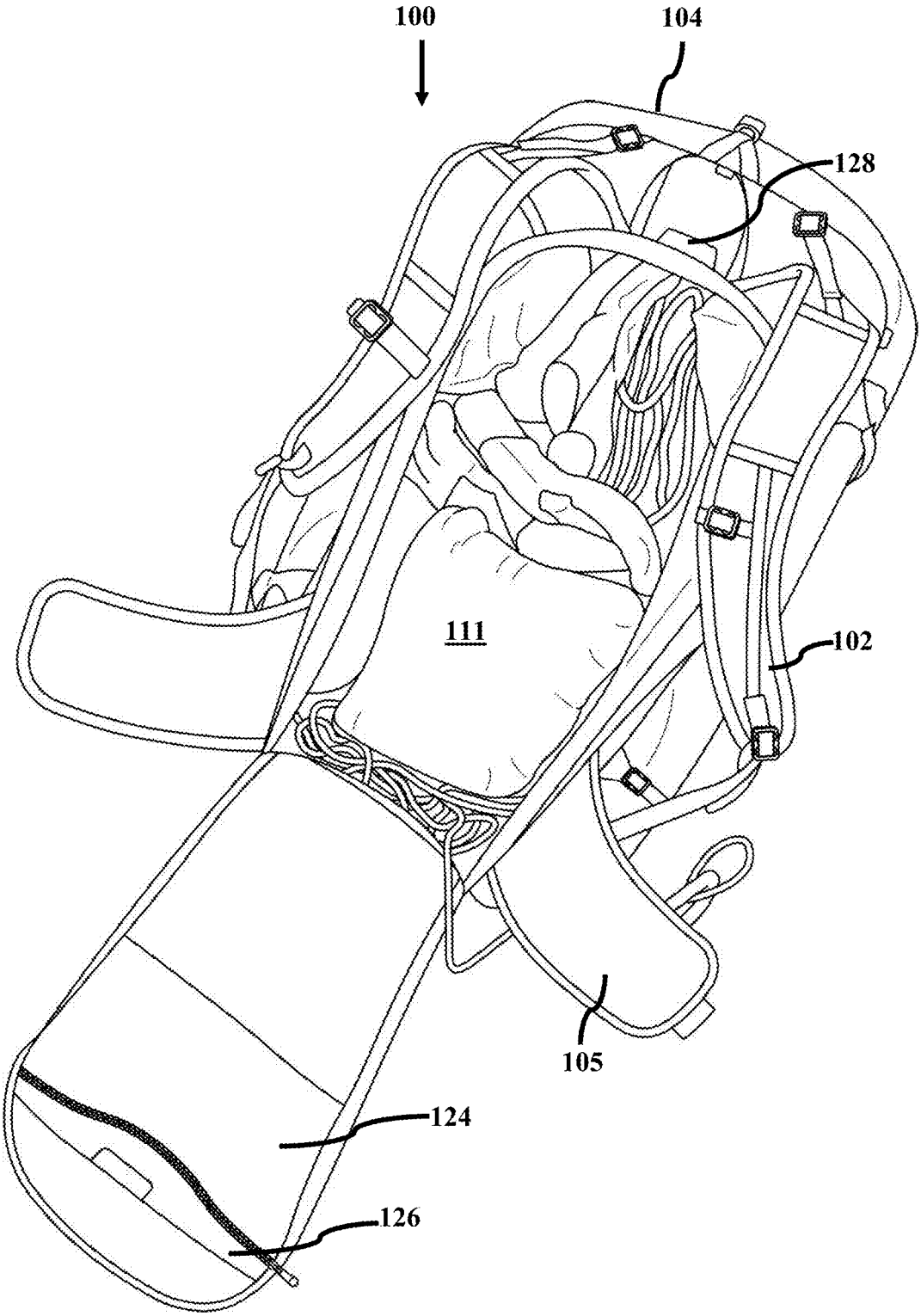
FIG. 5A illustrates a perspective view of the backpack when open, in accordance with various embodiments.

Referring to FIG. 5A and in continued reference to FIGS. 1-4, as shown, the first wall 106, second wall 108, and third wall 110 may define an interior volume 111 (illustrated in FIG. 5A). As shown in FIG. 5A, the interior volume 111 may allow a user to store gear, and other items. In various embodiments, the interior volume 111 may be large enough to accommodate multiple pieces of gear at once, such as for example, long probe(s), shovel(s), snow glove(s), radio(s), rope(s), snack(s), a helmet, a hydration bladder, an air supply apparatus, and the like.

In various embodiments, the interior volume 111 may be revealed or accessed by opening the first wall zipper 107 of the first wall 106. FIG. 5A shows part of the first wall 106 in an "open" position, in accordance with various embodiments. As shown, the first wall 106 may include an interior surface 124 defining a first wall pocket 126. In various embodiments, the first wall pocket 126 may include a fastening means, such as a zipper fastener, hook and loop fastener, and the like. In various embodiments, the first wall pocket 126 may be accessed by opening and closing the fastening means. In various embodiments, the first wall pocket 126 may be an open pocket.

In some aspects, the first wall pocket 126 may receive and store a removable first panel sheet. When not in use, the first panel sheet may be removed from the pack body 104 to reduce the weight of the backpack 100. In various embodiments, the first panel sheet may be removed from the pack body 104 to be used as a cushioning means, such as, for example, a knee pad, a seat, and the like. In various embodiments, the first panel sheet may be removed from the pack body 104 to be used for first aid, such as, for example, splinting a patient, separating a patient from the snow while awaiting rescue, and the like.

In various embodiments, the first panel sheet may be, for example, a polyethylene foam sheet. In various embodiments, the first panel sheet may be made of any material having a dimensional stability and recovery characteristic that provides cushioning and stability on impact.

As further shown in FIG. 5A, the first wall 106 may define at least one port 128 proximal the upper region 112*a* of the third wall 110 of the pack body 104. In various embodiments, the port 128 may allow access to a piece of equipment or gear, allowing such piece of equipment or gear to pass therethrough. For example, the port 128 may allow access to at least one of an air-supply mouthpiece and a hydration tube mouthpiece. Access to an air-supply mouthpiece may be beneficial in the event of an avalanche or snow collapse in which the user is buried under the snow. Without taking the backpack 100 off, the user may be able to access the air-supply mouthpiece at the port 128. Likewise, access to a hydration tube at the port 128 may reduce the inconvenience of doffing and donning the backpack 100, giving the user near immediate access to water (or other liquids) when needed.

In some aspects, providing further support and structure to the pack body 104, the pack body 104 may include a removable frame within the interior volume 111. In various embodiments, the removable frame may assist in distributing weight evenly across a user's back and hips. In some aspects, the removable frame may extend along the third wall 110 (e.g., a circumference of the interior volume 111), thereby following the pack body's shape and structure. In various embodiments, the removable frame may assist the user in carrying heavier loads for greater periods of time. In some aspects, a user may determine that the frame is not needed, and may elect to remove the frame, thereby further reducing the overall weight of the backpack 100.

In some aspects, interior surfaces of the first wall 106, second wall 108, and third wall 110 may further define a storage apparatus within the interior volume 111. The storage apparatus, which will be described in further detail in reference to the backpack 100 embodiment shown in FIGS. 6A-D, may comprise at least one sleeve capable of storing items, such as gear. In various embodiments, the storage apparatus may store items that a user may need on short notice in the backcountry, such as an avalanche probe and/or shovel. The storage apparatus may cordon off the gear stored therein from the rest of the contents stored within other parts of the interior volume 111. This may be desirable if the contents stored in the sleeves, such as gear, gets wet when being used. Accordingly, storing such contents in the storage apparatus may help reduce the likelihood of the other backpack contents getting wet.

Moreover, a user may want to reach their gear on a moment's notice whether for convenience or emergency purposes, or the environment may prevent the user from taking off the backpack 100 to reach stored items. Indeed, it may be advantageous for the user to reach items stored in the storage apparatus without having to take off the backpack 100 or open the first wall zipper 107.

Referring to FIGS. 5B-F, a storage apparatus may be accessible by one or more zippers located on the pack body 104. Each zipper may allow access to a corresponding sleeve within the interior volume 111. In various embodiments, the zippers may allow a user to reach contents stored in a storage apparatus within the interior volume 111 either when the backpack 100 is being worn, or when the user slings the backpack 100 over an arm and rotates the backpack 100 to reach the zippers.

Figure 5B:
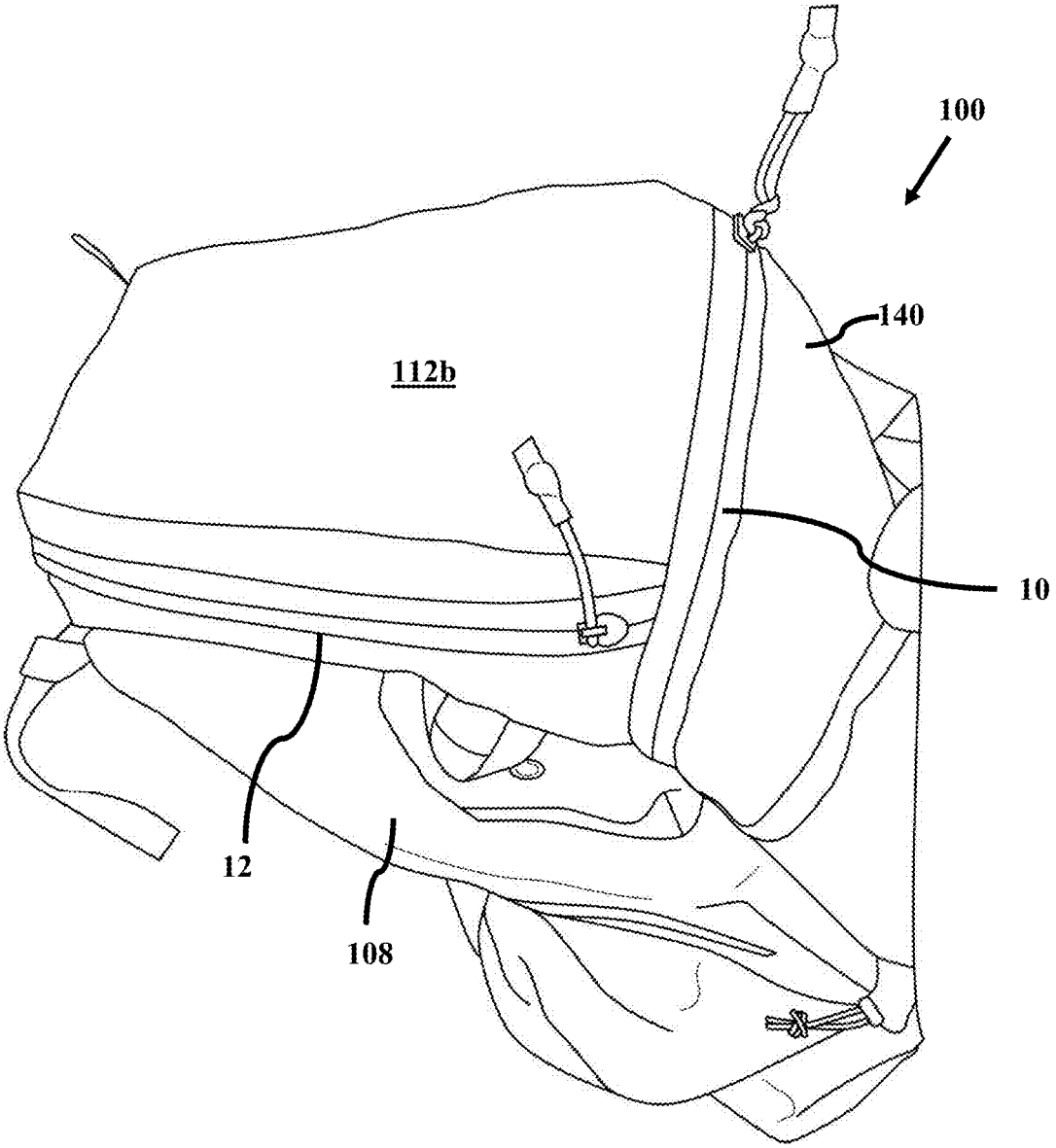
FIG. 5B illustrates a perspective view of a portion of the backpack, in accordance with various embodiments.
Figure 5C:
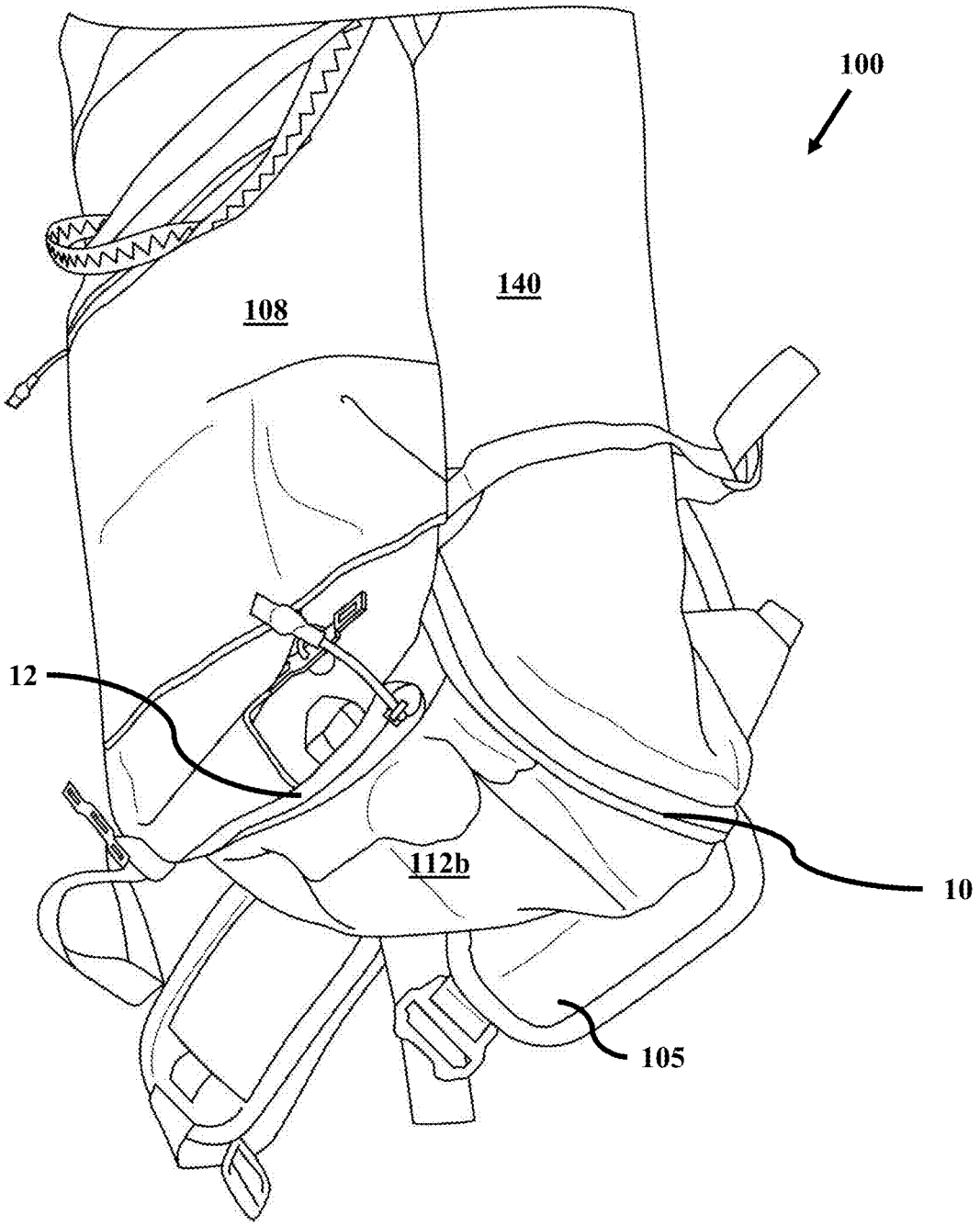
FIG. 5C illustrates a perspective view of a portion of the backpack, in accordance with various embodiments.
Figure 5D:
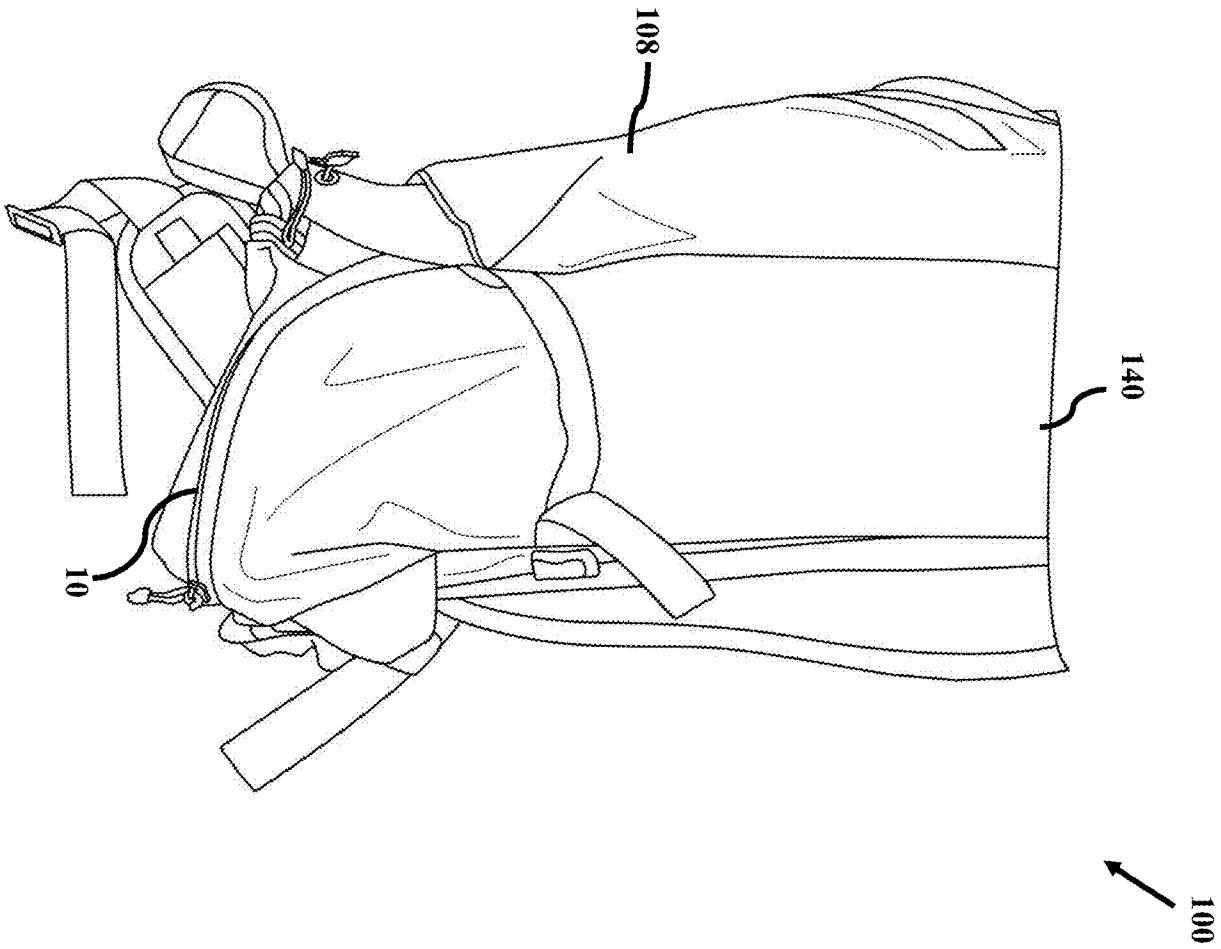
FIG. 5D illustrates a side view of a portion of the backpack, in accordance with various embodiments.
Figure 5E:
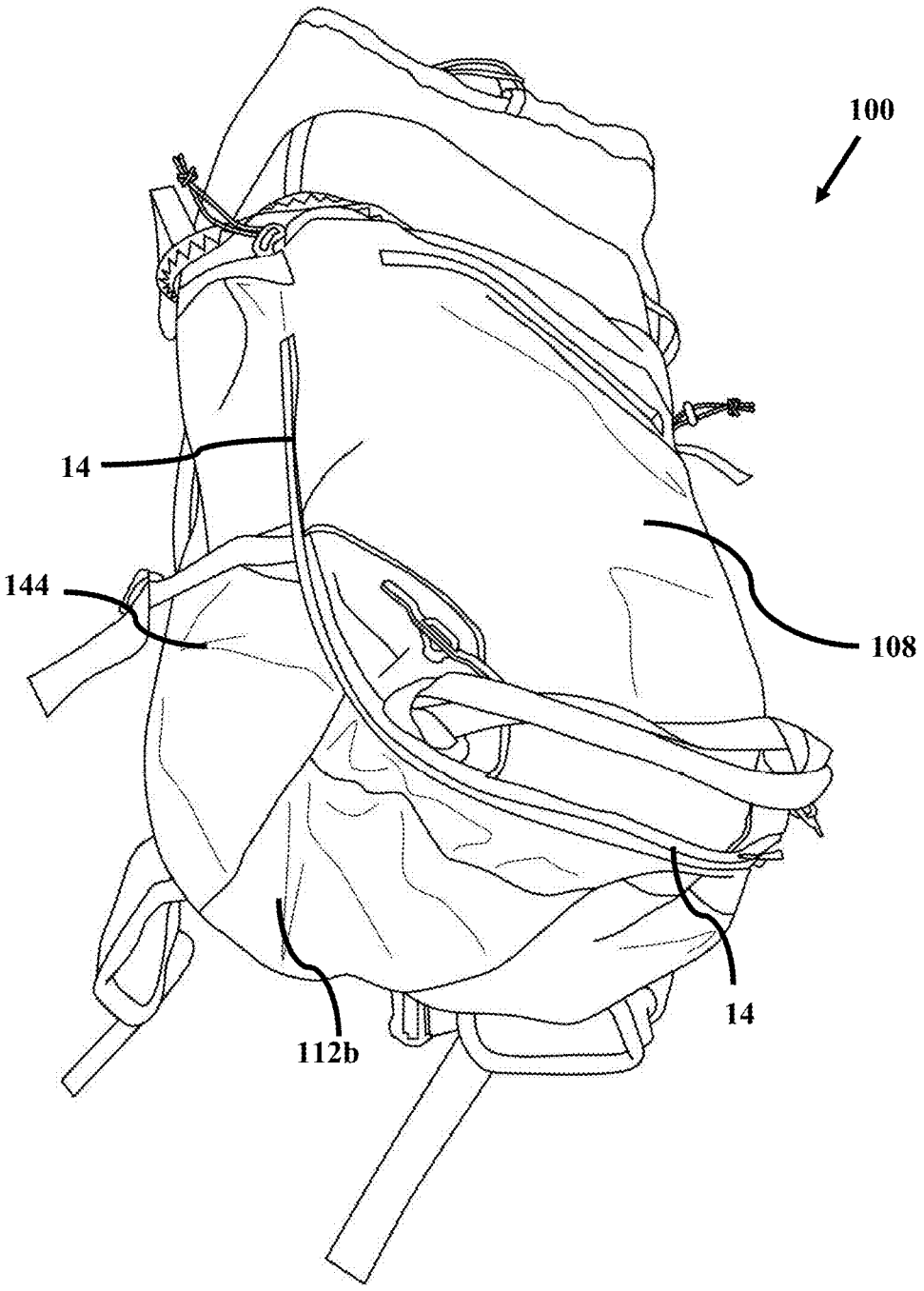
FIG. 5E illustrates a perspective view of the backpack, in accordance with various embodiments.
Figure 5F:
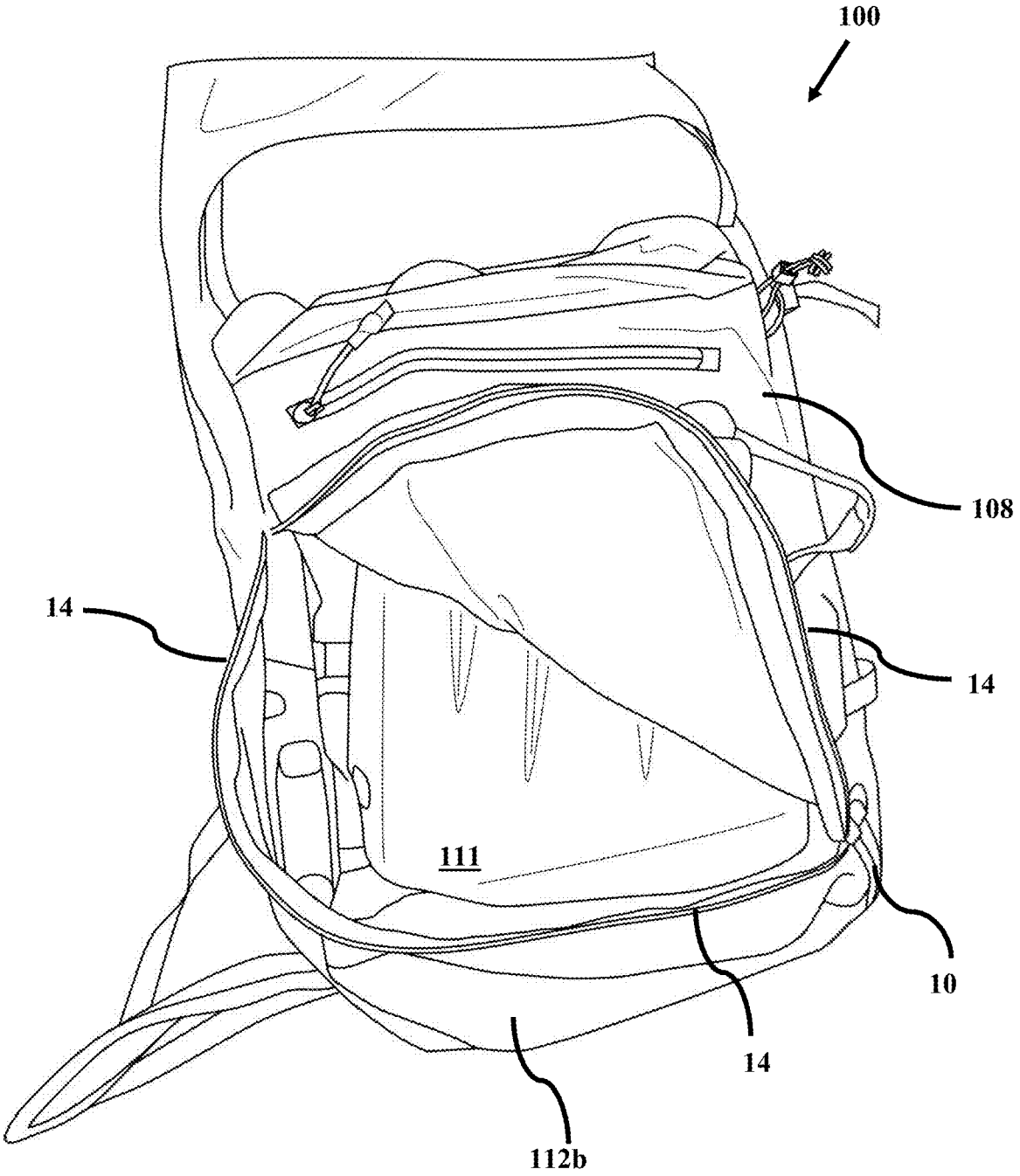
FIG. 5F illustrates a perspective view of the backpack when open, in accordance with various embodiments.

For example, FIGS. 5B-D illustrate perspective and side views of an exemplary embodiment of the backpack 100 of the present disclosure and FIGS. 5E-F illustrate perspective views of an alternative exemplary embodiment of the backpack 100 of the present disclosure.

As shown, the backpack 100 of FIGS. 5B-D may include a first lateral region zipper 10 and a base zipper 12. The first lateral region zipper 10 may be located proximately between the basal region 112*b* and the first lateral region 140 of the third wall 110 and may extend perpendicularly between the first wall 106 and second wall 108. The base zipper may be located proximately between the second wall 108 and the basal region 112*b* of the third wall 110 and may extend perpendicularly between the first lateral region 140 and the second lateral region 144.

In the alternative embodiment of FIGS. 5E-F, the backpack 100 may include the first lateral region zipper 10 and a perimeter wall zipper 14. As shown, the perimeter wall zipper 14 may trace a portion of a perimeter of the second wall 108. The perimeter wall zipper 14 may be located proximately between the second wall 108 and the basal region 112*b* of the third wall 110 and between the second wall 108 and the second lateral region 144 of the third wall 110. Accordingly, the perimeter wall zipper 14 may be an L-shaped zipper, matching the curved outline of the pack body 104 of the backpack 100. FIG. 5F illustrates the perimeter wall zipper 14 in an 'open' position, revealing the contents stored within the interior volume 111 of the pack body 104.

In either of the embodiments shown in FIGS. 5B-F, a user wearing the backpack 100 may reach behind and/or to their side to manipulate the first lateral region zipper 10, the base zipper 12, and/or the perimeter wall zipper 14, opening and closing the zippers 10-14 to remove or stow items, such as gear. The zippers 10-14 may be of the same or different lengths and widths, accommodating a variety of items. As shown and in accordance with various embodiments, the first lateral region zipper 10 may be smaller in length than either of the base zipper 12 or perimeter wall zipper 14. The perimeter wall zipper 14 may be larger in length than either of the base zipper 12 or first lateral region zipper 10.

In various embodiments, for example, the first lateral region zipper 10 may allow user access to an avalanche probe and/or a shovel rod (a shovel rod may include a shovel handle). In various embodiments, the base zipper 12 or perimeter wall zipper 14 may allow user access to a shovel blade. In various embodiments, the zippers 10-14 may enable user access directly into the interior volume 111 and/or directly into a storage apparatus defined by the first wall 106, second wall 108, and third wall 110.

FIGS. 6A-D illustrate another alternative exemplary embodiment of the backpack 100 of the present disclosure. As shown, the backpack 100 may include a storage apparatus 120 within the interior volume 111. Moreover, FIGS. 6A-D illustrate perspective and top-down views of the storage apparatus 120 and interior volume 111 of the backpack 100, in accordance with various embodiments.

Figure 6A:
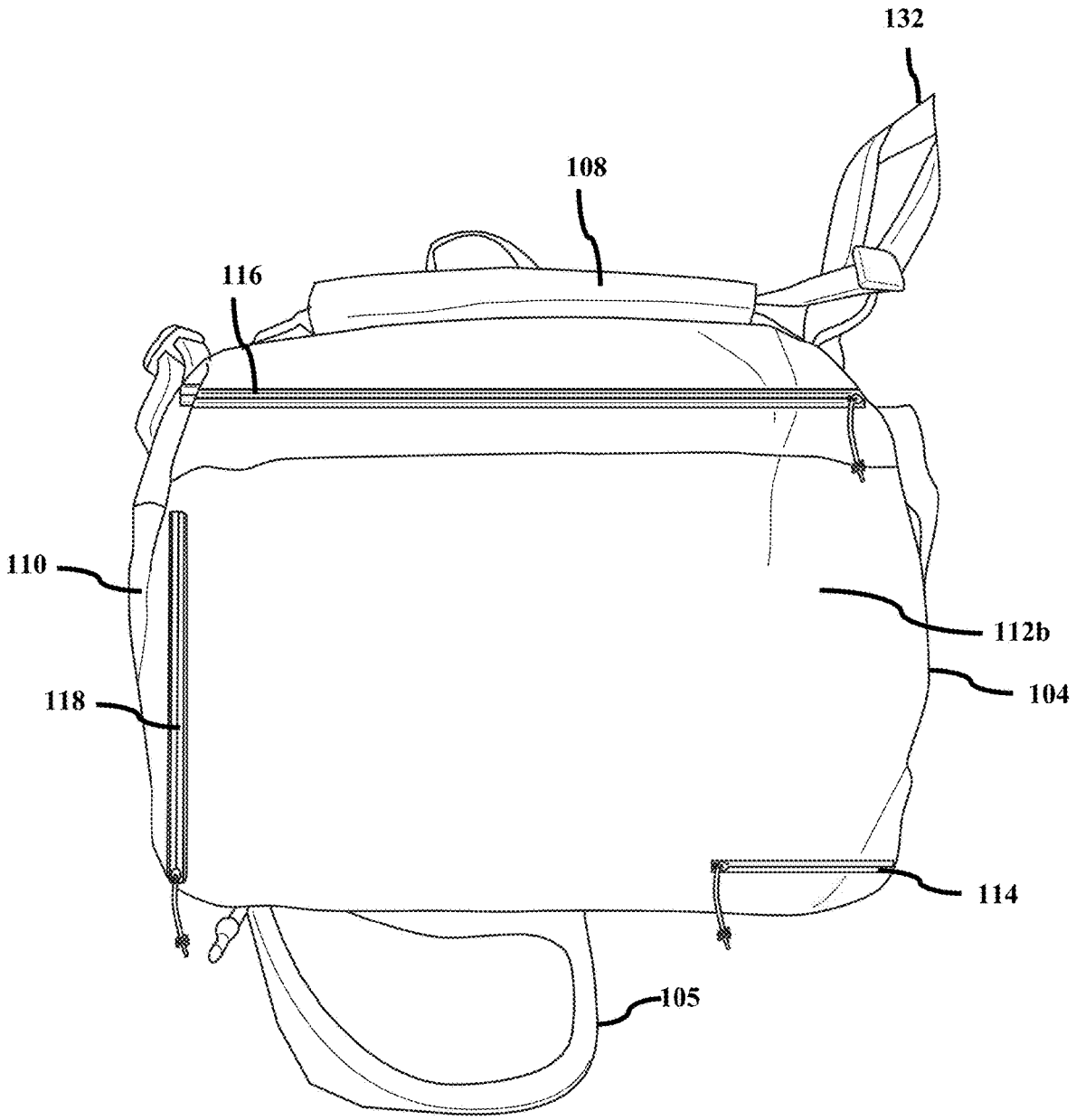
FIG. 6A illustrates a perspective view of a basal region of the backpack, in accordance with various embodiments.

As shown in FIG. 6A, the basal region 112*b* may include a first basal zipper 114, a second basal zipper 116, and a third basal zipper 118. These zippers 114-118 at the basal region 112*b* may allow the user to access the interior volume 111 of the pack body 104. In various embodiments, this accessibility (e.g., reaching down to the basal region 112*b*) may allow a user the ability to access contents stored within the interior volume 111 without the need for doffing and donning the backpack, or otherwise rearranging the contents stored within the interior volume 111.

Each of the basal zippers 114-118 may be arranged in any desirable orientation at the basal region 112*b* and may be of the same or different lengths and widths. As shown and in accordance with various embodiments, of the three zippers, the first basal zipper 114 may be most proximal the first lateral region 140 at where the first lateral region 140 of the third wall 110 is connected to the first wall 106. Moreover, as shown and in accordance with various embodiments, of the three zippers, the second basal zipper 116 may be most proximal the second wall 108. Moreover, as shown and in accordance with various embodiments, of the three zippers, the third basal zipper 118 may be most proximal the second lateral region 144, extending from a point where the second lateral region 144 of the third wall 110 is connected to the first wall 106 to a point where the second lateral region 144 of the third wall is connected to the second wall 108.

In various embodiments, the first basal zipper 114 may be substantially parallel to the first wall 106. In other embodiments, the first basal zipper 114 may be substantially perpendicular to the first wall 106. In various embodiments, the second basal zipper 116 may be substantially parallel to the second wall 108. In other embodiments, the second basal zipper 116 may be substantially perpendicular to the second wall 108. In various embodiments, the third basal zipper 118 may be substantially perpendicular to the first wall 106 and second wall 108. In various embodiments, the third basal zipper 118 may be substantially parallel to the first wall 106 and the second wall 108. In other embodiments, the first basal zipper 114 may be substantially perpendicular to the first wall 106.

Figure 6B:
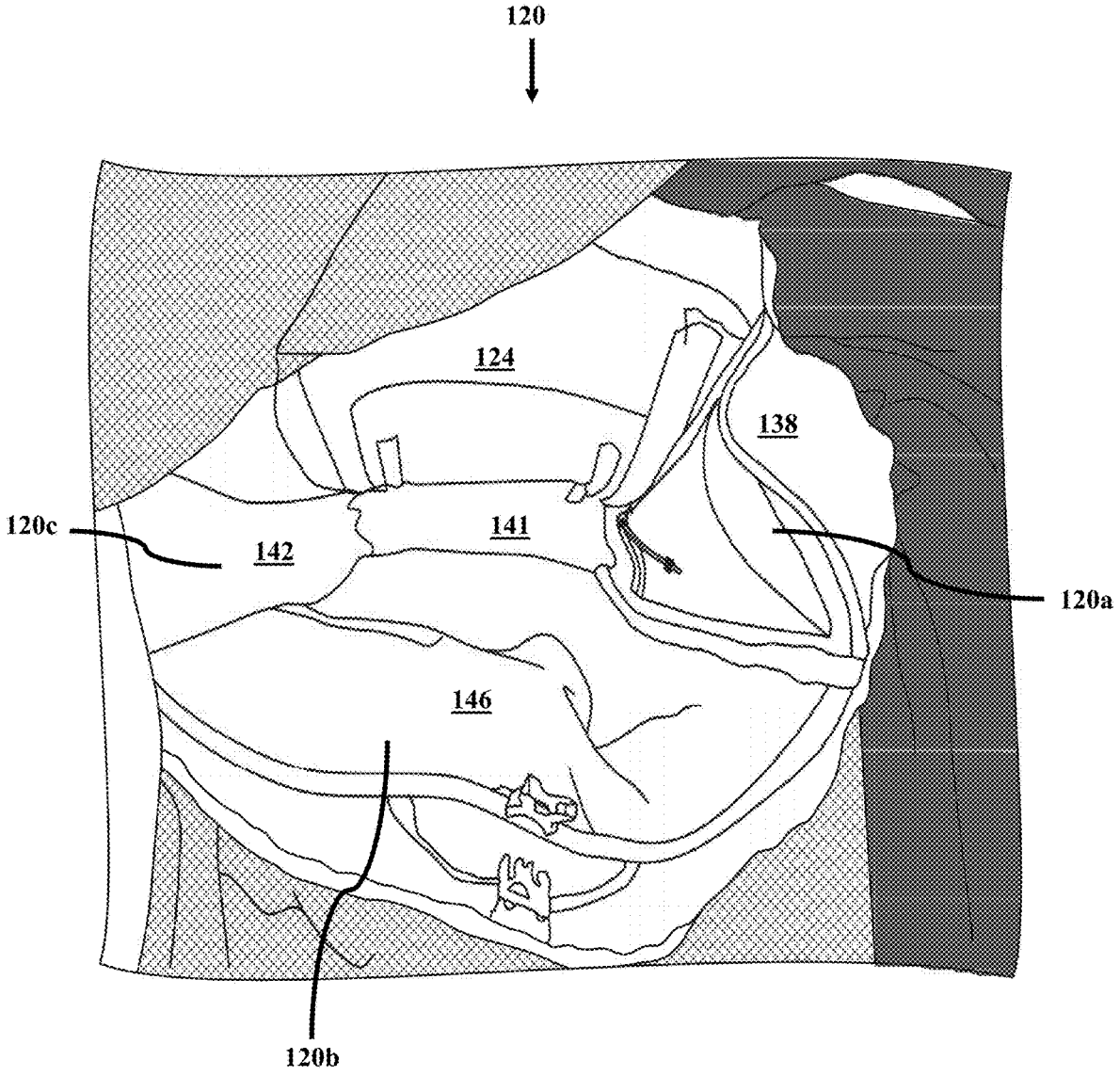
FIG. 6B illustrates a top-down view of a portion of an interior volume of the backpack, in accordance with various embodiments.
Figure 6C:
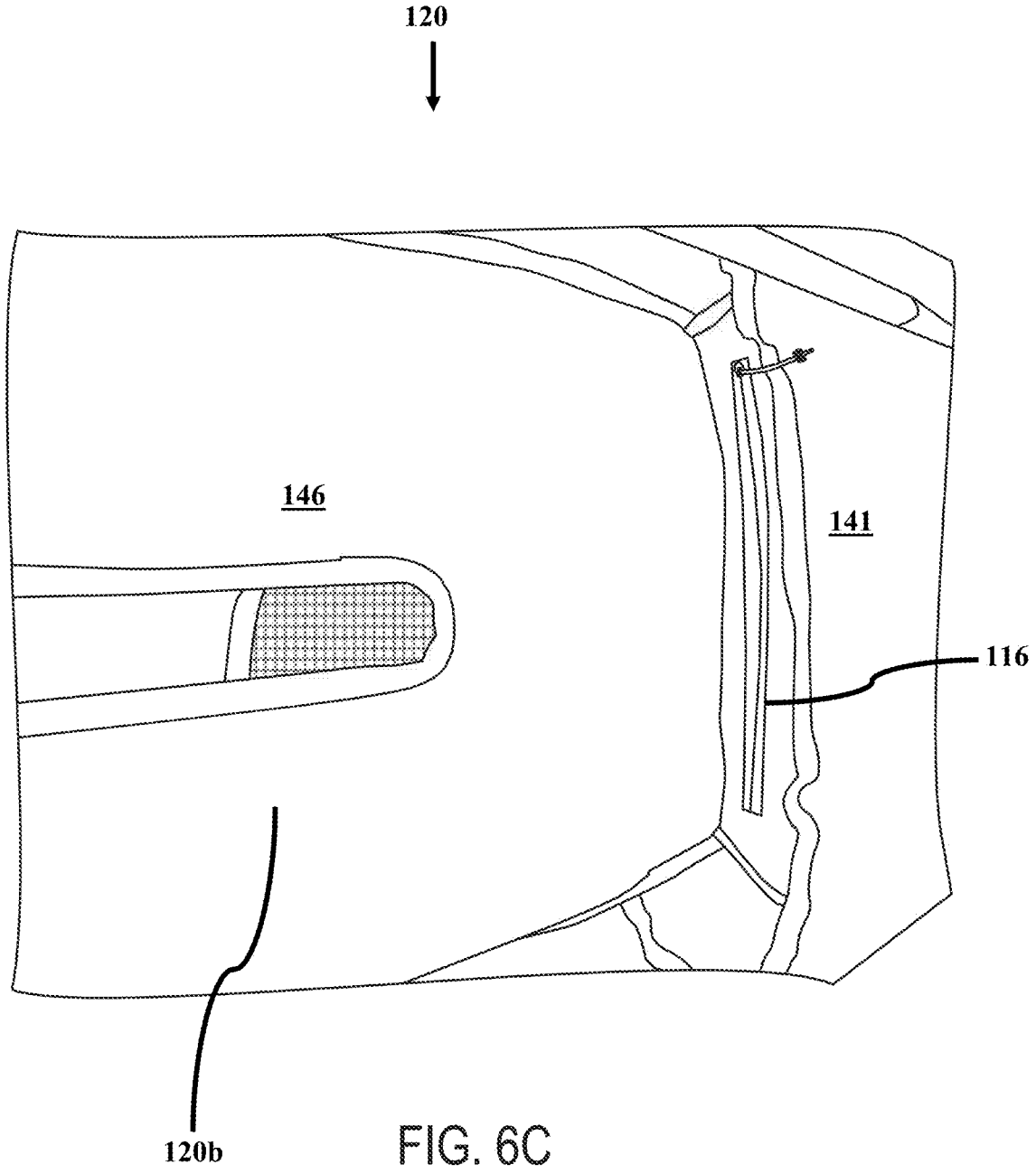
FIG. 6C illustrates a perspective view of a portion of the backpack's interior volume, in accordance with various embodiments.
Figure 6D:
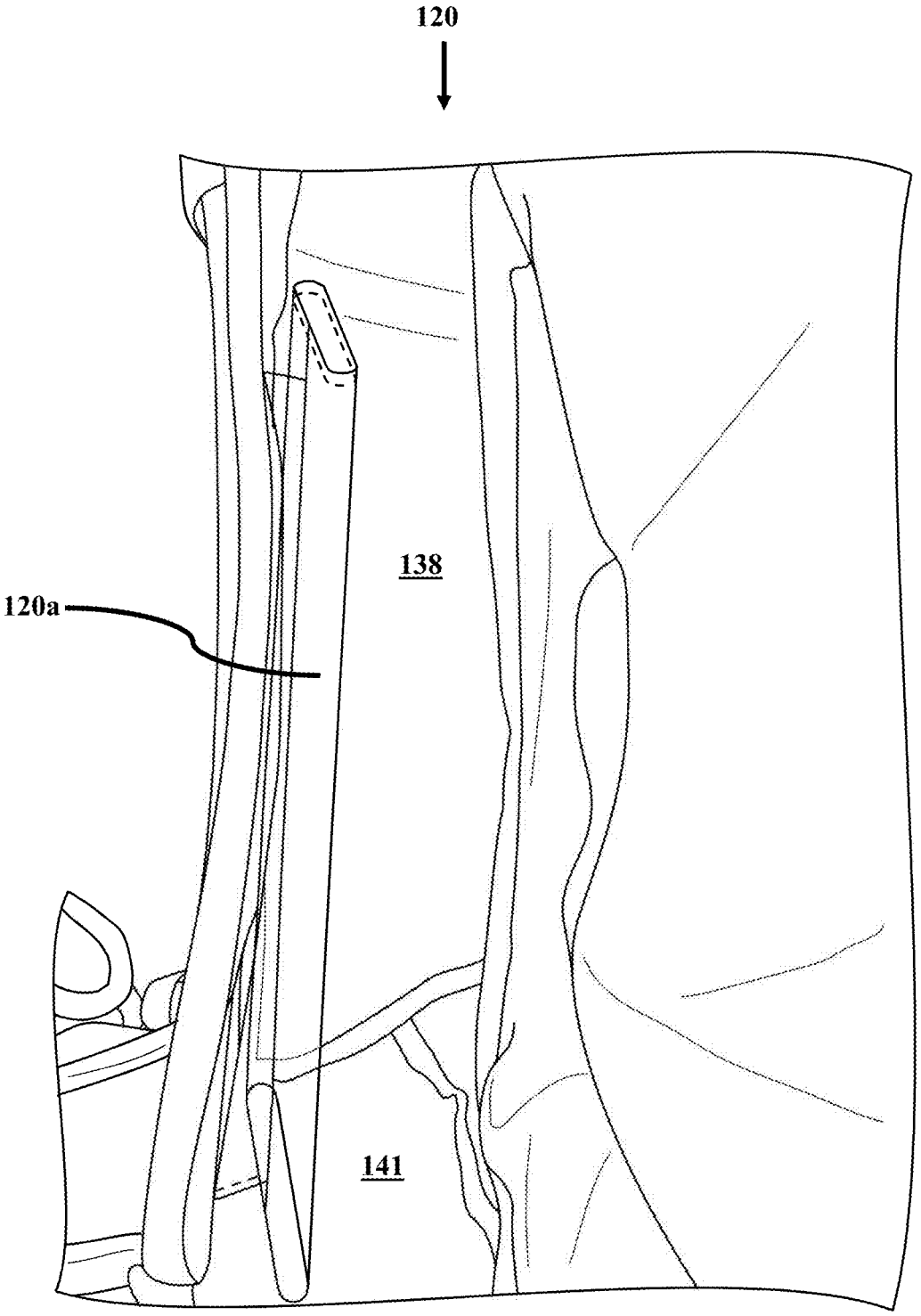
FIG. 6D illustrates a perspective view of a portion of the backpack's interior volume, in accordance with various embodiments.

In various embodiments, the first, second, and third basal zippers 114-118 may allow a user access to the storage apparatus 120 within the interior volume 111. As shown in FIGS. 6B-D, the storage apparatus 120 may include a first sleeve 120*a*, a second sleeve 120*b*, and a third sleeve 120*c*. The inventor has contemplated that the sleeves described herein may be applicable to any of the embodiments of the backpack of the present disclosure.

Each of the first sleeve 120*a*, second sleeve 120*b*, and third sleeve 120*c* may be accessible at the basal region 112*b* by opening and closing the corresponding first zipper 114, second zipper 116, and third zipper 118.

FIGS. 6B-6D illustrate the storage apparatus 120 and interior volume 111 of the backpack 100, in accordance with various embodiments. As shown in FIGS. 6B and 6D, in various embodiments, the first sleeve 120*a* may be defined by an interior surface 138 of the first lateral region 140 of the third wall 110 and an interior surface 141 of the basal region 112*b*. In various embodiments, the first basal zipper 114 may interface with the interior surface 141 of the basal region 112*b*, giving a user access to the first sleeve 120*a* (FIGS. 6B and 6D) at the basal region 112*b*.

Moreover, as shown in FIGS. 6B and 6C, in various embodiments, the second sleeve 120*b* may be defined by an interior surface 146 of the second wall 108 and the interior surface 141 of the basal region 112*b*. In various embodiments, the second basal zipper 116 may interface with the interior surface 141 of the basal region 112*b*, giving a user access to the second sleeve 120*b* (FIGS. 6B and 6C) at the basal region 112*b*.

Moreover, as shown in FIG. 6B, in various embodiments, the third sleeve 120*c* may be defined by an interior surface 142 of the second lateral region 144 and the interior surface 141 of the basal region 112*b*. In various embodiments, the third basal zipper 118 may interface with the interior surface 141 of the basal region 112*b*, giving a user access to the third sleeve 120*c* (FIG. 6B) at the basal region 112*b*.

In various embodiments, the first sleeve 120*a*, second sleeve 120*b*, and third sleeve 120*c* of the storage apparatus 120 may cordon off contents stored in the sleeves from the rest of the contents within the interior volume 111. This may be desirable if the contents stored in the sleeves, such as gear, gets wet when being used. Accordingly, storing such contents in the sleeves 120*a*-120*c* may help reduce the likelihood of the other backpack contents getting wet.

In addition, the structure of the sleeves 120*a-c* (each defined from the interior surface 141 of the basal region 112*b*), may allow the user direct access to the contents of the sleeves 114-118 by opening and closing the corresponding basal zippers 114-118, thereby leaving the rest of backpack contents largely undisturbed when opening and closing the basal zippers 114-118.

The storage apparatus 120 of the backpack 100 may enable quick, efficient, neat, and convenient access to whatever contents may be stored in the storage apparatus 120, without the need to doff and don the backpack 100 or otherwise disturb the rest of the backpack's contents. Indeed, many users of the backpack 100, especially those who venture into the great outdoors, may want to maximize the space allowed for storing items in the interior volume (as well as other areas of the backpack 100) and may therefore spend considerable time initially packing items in the backpack 100. Repeatedly donning and doffing the backpack to open the backpack to remove (and re-store) items may disrupt a user's meticulous and organized arrangement of items within the backpack 100.

Accordingly, the storage apparatus 120 may be beneficial to users who may need (or may conveniently want) stored contents and/or their most important contents at a moment's notice. In various embodiments, the storage apparatus 120 may be beneficial to users who do not want to get the backpack 100 (or its other contents) wet and/or dirty unnecessarily, and who want to avoid the arduous task of repeatedly rearranging the contents within the backpack 100, saving time, energy, and in some cases where damage from the elements is prevented, money.

Figure 7:
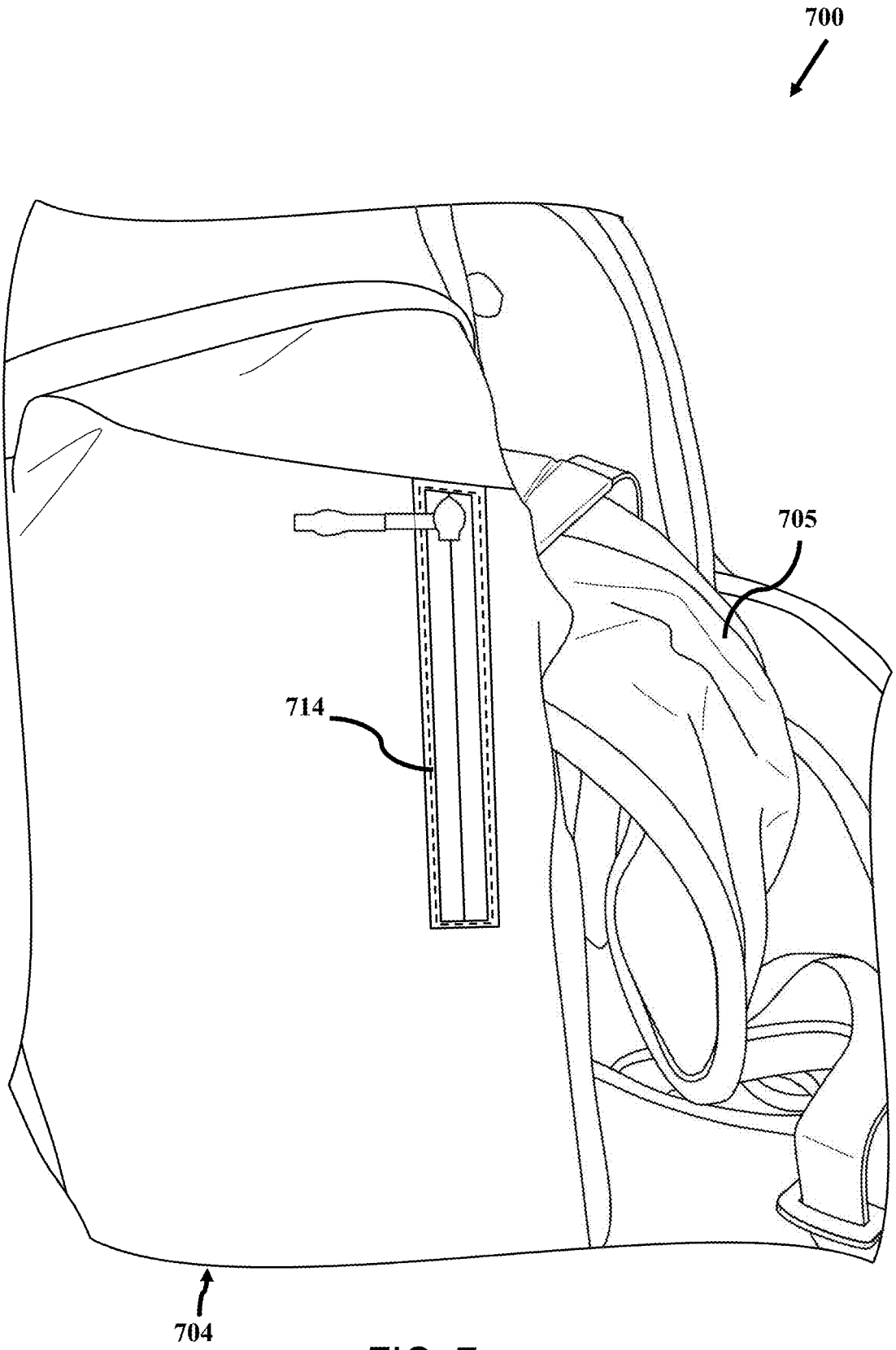
FIG. 7 illustrates a perspective view of a portion of a backpack, in accordance with various embodiments.

FIG. 7 illustrates a perspective view of a portion of a backpack 700, in accordance with various embodiments. As shown, the backpack 700 may include a pack body 704 and a hip pad 705. As shown, the backpack 700 may include just one basal region zipper 714 on the pack body 704. The basal region zipper 714 may allow a user access to contents within the pack body 704 at a basal region of the pack body, allowing the user the ability to withdraw and store items within the pack body 704 without the need to doff and don the backpack 700.

Figure 8:
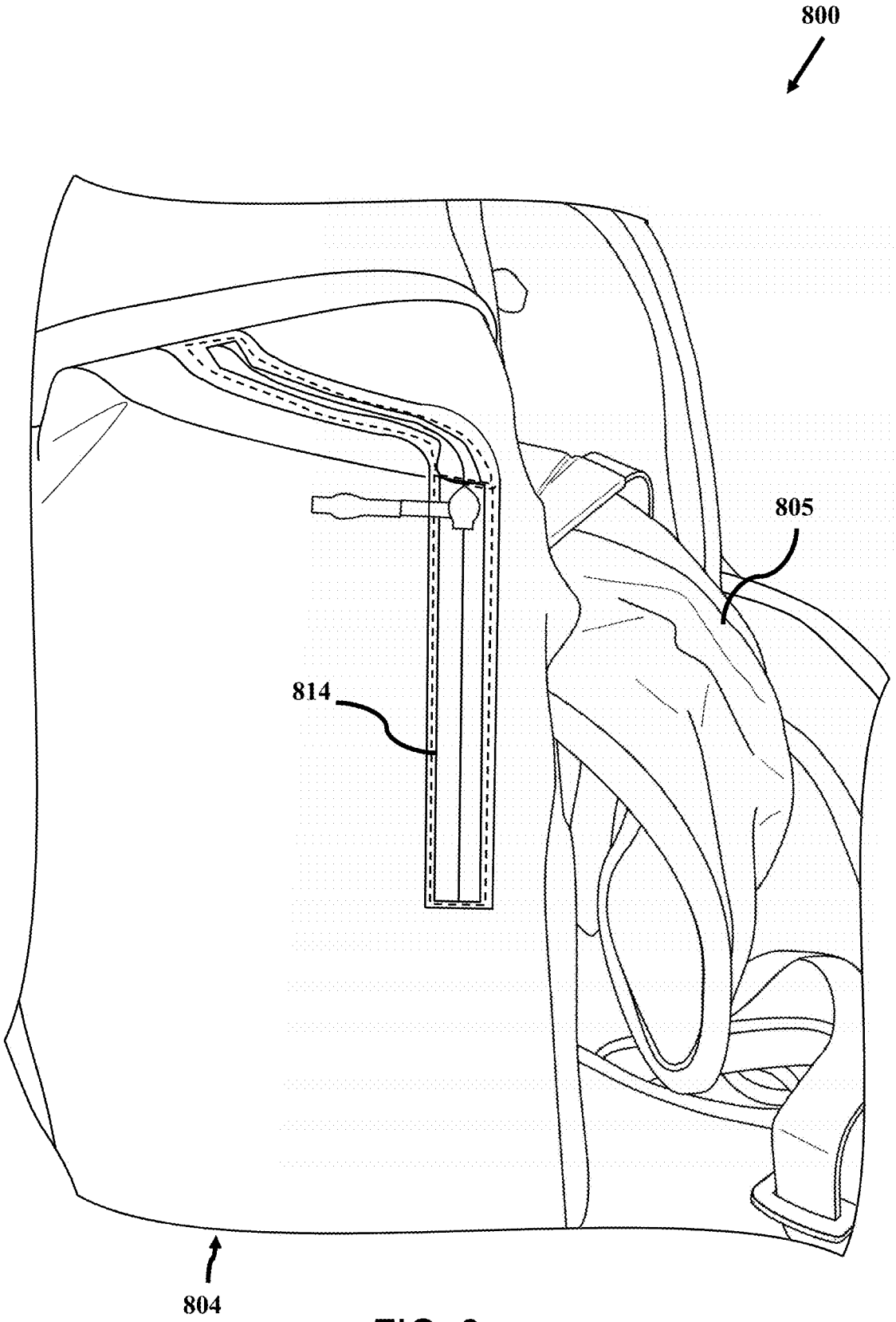
FIG. 8 illustrates a perspective view of a portion of a backpack, in accordance with various embodiments.

FIG. 8 illustrates a perspective view of a portion of a backpack 800, in accordance with various embodiments. As shown, the backpack 800 may include a pack body 804 and a hip pad 805. As shown, the backpack 800 may include a zipper 814 extending from a basal region of the pack body 804 to a lateral region of the pack body 804. In various embodiments, the backpack 800 may include just one lateral region zipper on the pack body 804. As shown, the zipper 814 may allow a user access to contents within the pack body 804 at both the basal and lateral regions of the pack body 804, allowing the user the ability to withdraw and store items within the pack body 804 without the need to doff and don the backpack 800. In various embodiments, the pack body 804 may include just one lateral region zipper that allows allow a user access to contents within the pack body 804 at the lateral region of the pack body 804, allowing the user the ability to withdraw and store items within the pack body 804 without the need to doff and don the backpack 800.

In some respects, the shoulder strap(s) 102, pack body 104, first wall 106, second wall 108, third wall 110, first sleeve 120*a*, second sleeve 120*b*, and third sleeve 120*c* may be made of the same or different materials. In various embodiments, the backpack 100 may be made of woven nylon. In various embodiments, the backpack 100 may be made of fabric. In various embodiments, the backpack 100 (and elements thereof) may be made of, for example, a waterproof fabric. In various embodiments, the backpack 100 (and elements thereof) may be made of, for example, a laminated fabric comprising a polyethylene (PE) fabric, a polyester plain woven face, and a polyethylene terephthalate (PET) film coating. In various embodiments, the backpack 100 (and elements thereof) may be made of, for example, a laminated fabric comprising a polyethylene (PE) fabric, a polyester plain woven face, a crossply, and a polyethylene terephthalate (PET) film coating. In various embodiments, the backpack 100 (and elements thereof) may be made of, for example, a laminated fabric comprising an ultra-high molecular weight polyethylene (UHMWPE) fabric, a polyester plain woven face, a crossply, and a polyethylene terephthalate (PET) film coating. In various embodiments, the backpack 100 (and elements thereof) may further include polyvinyl fluoride (PVF) material. In various embodiments, the backpack 100 (and elements thereof) may further include nylon, woven nylon, elastane, UHMWPE crossply, UHMWPE ripstop, UHMWPE woven, and the like.

In various embodiments, the removable frame may be comprised of, for example, a metal, such as aluminum, steel, brass, nickel, copper and the like. In various embodiments, the removable frame may be an aluminum tubing ranging in diameter between 1 millimeter (mm)-3 mm, 3-5 mm, 5-7 mm, 7-9 mm, 9-15 mm, and 15-20 mm. In various embodiments, the removable frame may be an aluminum tubing having a diameter of 7 mm.

In various embodiments, the backpack 100 may comprise an interior volume 111 of between 20 liters (L)-30 L, 30 L-40 L, 40 L-50 L, 50 L-60, and 60 L-70 L. In various embodiments, the backpack 100 may comprise an interior volume 111 of, for example, 40 L. In various embodiments, the backpack 100 may comprise an interior volume 11 of, for example 40 L, expandable to 50 L.

In various embodiments, the first wall 106 of the pack body 104, as measured between the basal region 112*b* to the upper region 112*a* of the third wall 110 may range in length between 10 inches (in)-14 in, 14 in-18 in, 18 in-22 in, 22-26 in, 26 in-30 in, and 30 in-34 in. In various embodiments, the second wall 108 and each of the lateral walls 140/144 of the third wall 110 may have the same length as the first wall 106.

In various embodiments, the upper region 112*a* and the basal region 112*b*, as measured between the first lateral wall 140 and second lateral wall 144 of the third wall 110 may range in width between 8 inches (in)-9.5 in, 9.5 in-11 in, 11 in-12.5 in, 12.5 in-14.5 in, 14.5 in-16.5 in, and 16.5 in-18.5 in. In various embodiments, the upper region 112*a* and basal region 112*b* may each be 12.5 in wide. In various embodiments, the upper region 112*a* and basal region 112*b* may have the same widths. In other embodiments, the upper region 112*a* and basal region 112*b* may have different widths. The various zippers of the backpack 100 may be configured into any size relative to the length and/or width of the walls of the pack body 104 (e.g., the first wall 106, second wall 108, and the walls and regions of the third wall 110: the upper region 112*a*, basal region 112*b*, first lateral wall 140, second lateral wall 144). For instance, the size of the zippers may be ratios of length and/or width relative to the length and/or width of the walls of the pack body 104, ranging from 1-20 percent (%), 20-40%, 40-60%, 60-80%, and/or 80-100% of the length and/or width of the walls of the pack body 104.

An ultralight backcountry backpack is also disclosed herein, in accordance with various embodiments. FIGS. 9-12 illustrate perspective views of the ultralight backcountry backpack in accordance with various embodiments.

Figure 9:
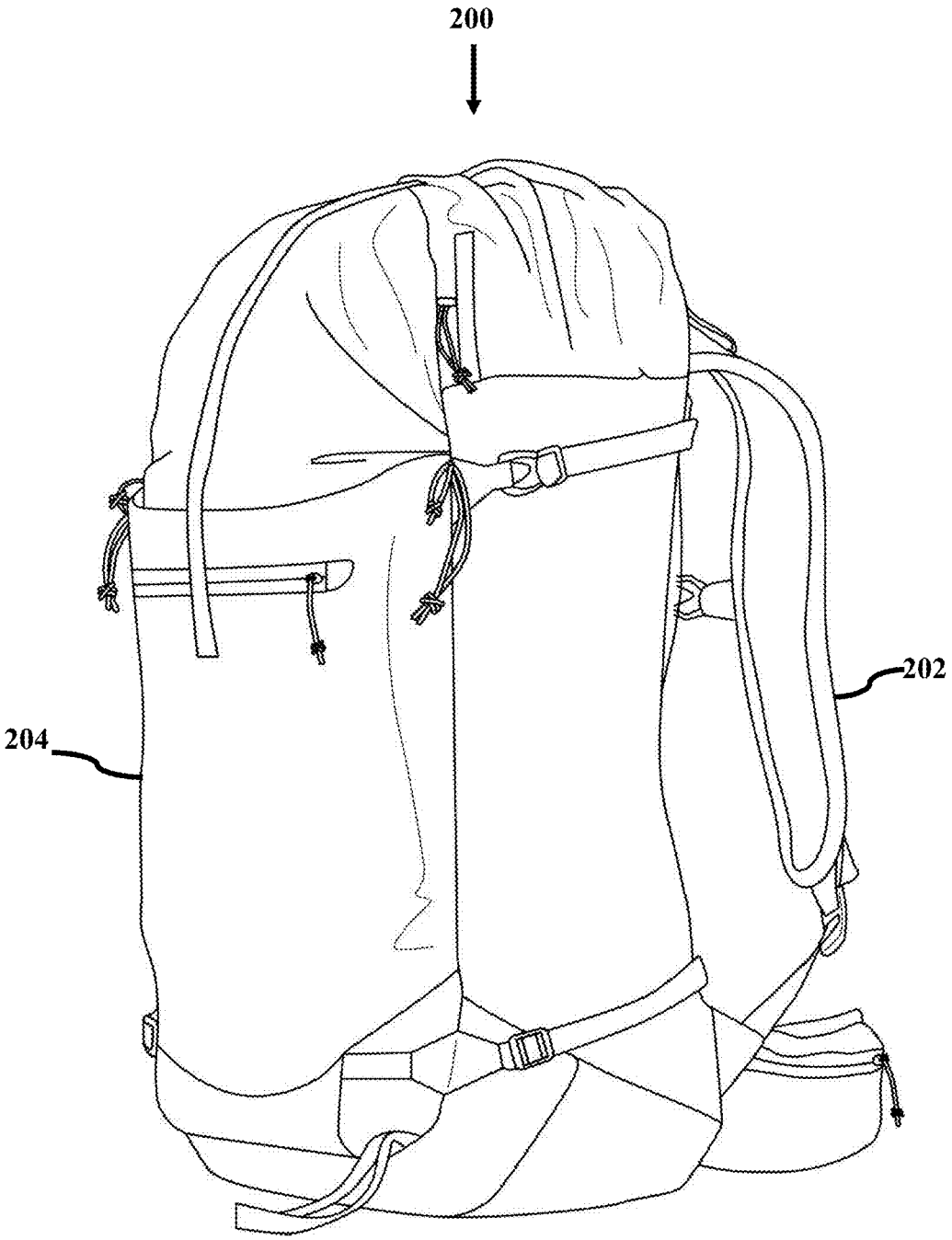
FIG. 9 illustrates a perspective view of an ultralight backcountry backpack, in accordance with various embodiments.
Figure 10:
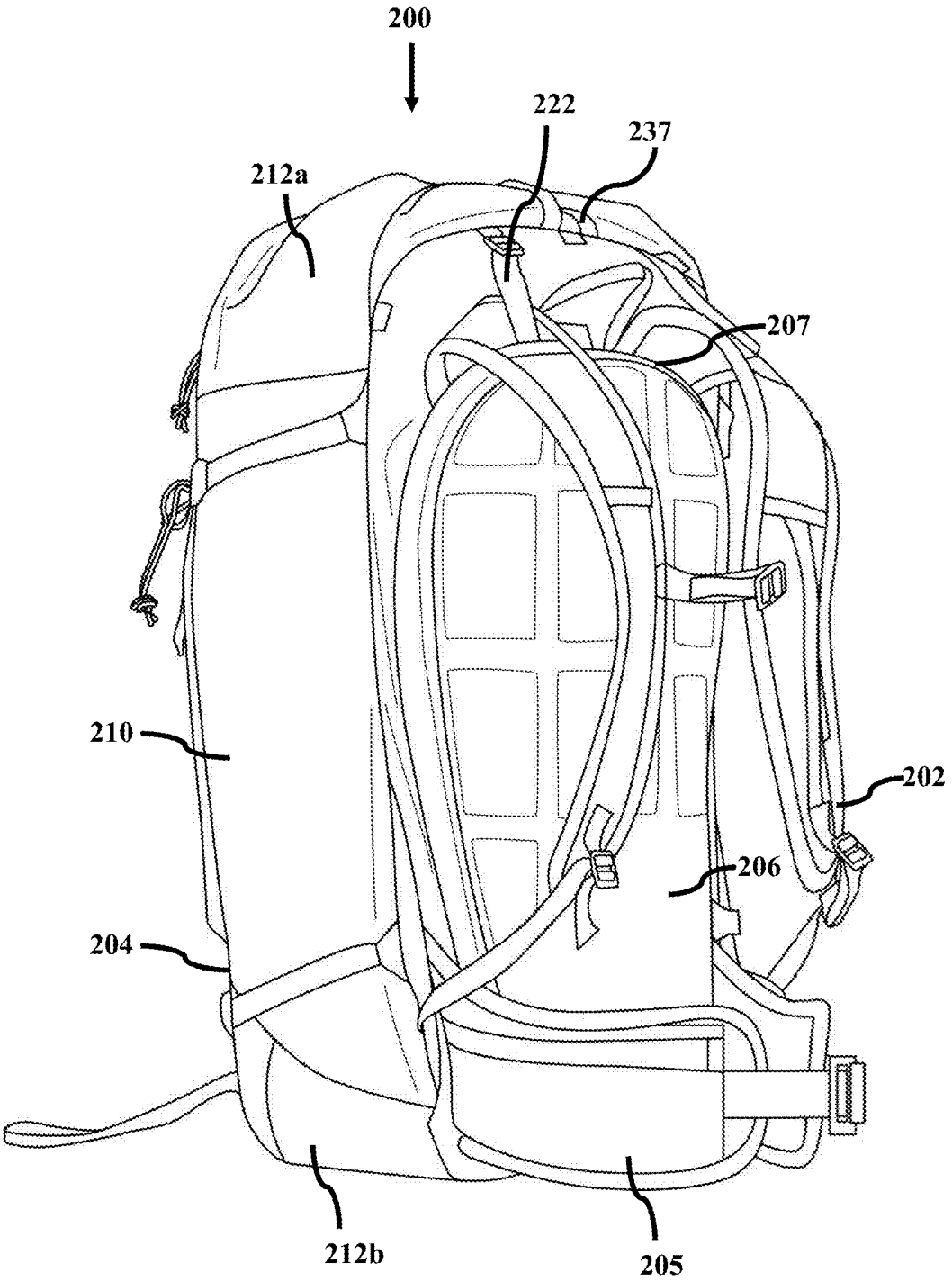
FIG. 10 illustrates a perspective view of the ultralight backcountry backpack, in accordance with various embodiments.

As shown in FIGS. 9 and 10, the ultralight backcountry backpack 200 may include at least one shoulder strap 202 connected to a pack body 204. In some aspects, the pack body 204 may include a back wall 206. In various embodiments, the back wall 206 may include a back wall zipper 207 that enables user access to contents (e.g., gear) stowed in the pack body 204. In various embodiments, the back wall 206 of the pack body 204 may interface with a user's back when the backpack is worn.

Moreover, as shown in FIGS. 9 and 10, the shoulder strap 202 may be connected to the pack body 204 at the back wall 206. In some aspects, the shoulder strap 202 may include at least one adjustable load lifter strap 222 proximal an upper region 212*a* of the pack body 204. In various embodiments, the adjustable load lifter strap 222 may further connect the shoulder strap 202 to the back wall 206, stabilizing the ultralight backcountry backpack 200 when used. In various embodiments, the adjustable load lifter strap 222 may shift and/or disperse the load (e.g., weight) from the user's shoulder by lifting part of the load off the user's shoulder when the backpack 200 is worn, increasing comfort to the user, decreasing user fatigue, and improving stability.

In various embodiments, the pack body 204 may include at least one hip pad 205. The hip pad 205 may further increase stability to the user when carrying the backpack 200 by transferring the weight of the backpack 200, shifting part of the load from the user's shoulder to the user's hips. In doing so, the hip pad 205 may allow a user's legs (which are generally stronger than a user's shoulders) to bear much of the backpack's weight. In various embodiments, the hip pad 205 may be padded. In other embodiments, the hip pad 205 may be webbed. In various embodiments, and as will be discussed further below the hip pad 205 may be removable, slideable, and otherwise capable of being manipulated by the user.

In various embodiments, the pack body 204 may allow a user to store gear and other items. In one exemplary embodiment, the pack body 204 may be large enough to accommodate multiple pieces of gear at once, such as for example, long probe(s), shovel(s), snow glove(s), radio(s), rope(s), snack(s), a helmet, a hydration bladder, an air supply apparatus, and the like.

Moreover, referring to FIGS. 9-11*b*, the pack body 204 may further include a front wall 208 that is distal to the back wall 206. In various embodiments, the pack body 204 may further include a perimeter wall 210 connecting the back wall 206 and front wall 208. As shown in FIG. 10, the perimeter wall 210 may include an upper region 212*a* and a basal region 212*b*. In various embodiments, when the backpack 200 is being worn by a user, the upper region 212*a* of the perimeter wall 210 may be proximal the user's upper back, neck, and head region.

Figure 11A:
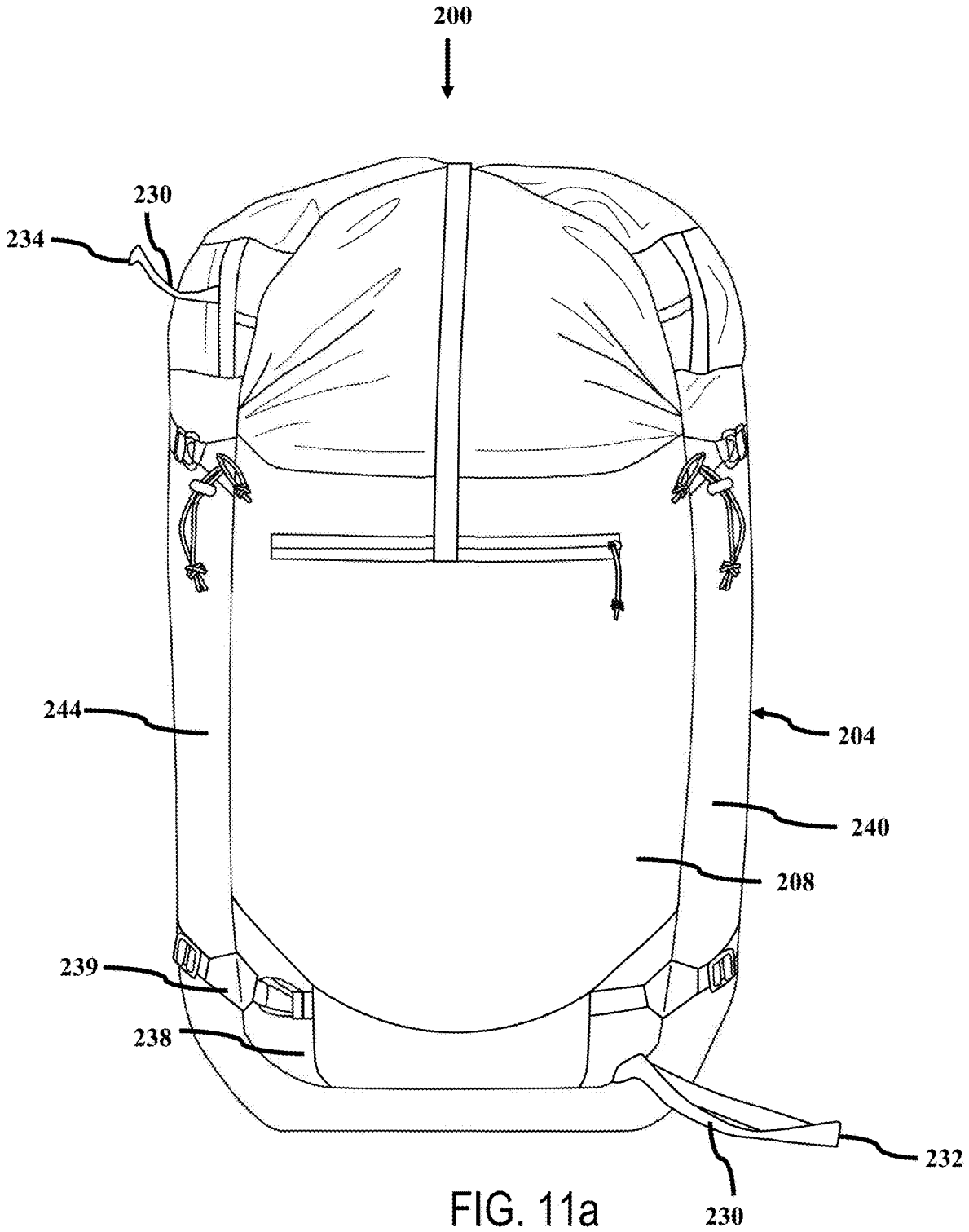
FIG. 11*a* illustrates a perspective view of the ultralight backcountry backpack, in accordance with various embodiments.

Likewise, when the backpack 200 is being worn by the user, the basal region 212*b* of the perimeter wall 210 may be proximal the user's lower back, tailbone, and leg region. In various embodiments, the perimeter wall 210 may further include at least one lateral region. For example, as shown in FIG. 11*a*, the perimeter wall 210 may include a first lateral region 240 and a second lateral region 244. In various embodiments, the first lateral region 240 may be distal the second lateral region 244. Accordingly, in various embodiments, the perimeter wall 210 connecting the back wall 206 and front wall 208 may include upper 212*a*, basal 212*b*, first lateral 240, and second lateral 244 regions.

Moreover, as shown in FIG. 11*a*, the front wall 208 of the pack body 204 may define at least one pocket 238. In various embodiments, the pocket 238 may be an ice tool pocket. In various embodiments, the ice tool pocket may receive an avalanche tool, such as, for example, an ice tool pick. In various embodiments, the front wall 208 may further include at least one buckle 239 that secures an ice tool pick when stowed in the pocket 238. Stowing an item such as an ice tool pick in the pocket 238 of the front wall 208 may allow a user to quickly access the pick, and more easily retrieve and re-stow the pick than if the pick were stored within the pack body 204.

Figure 11B:
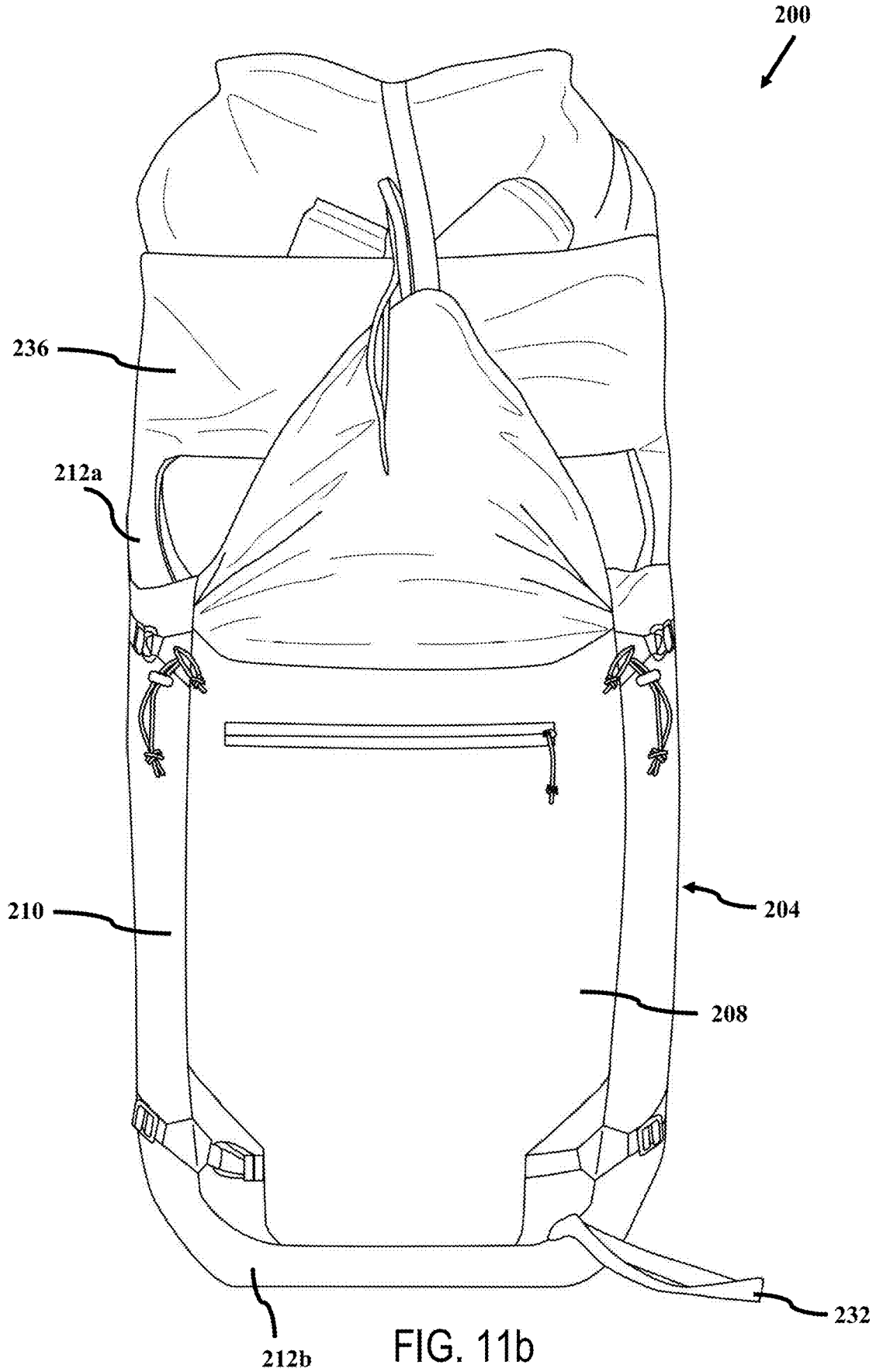
FIG. 11*b* illustrates a perspective view of the ultralight backcountry backpack, in accordance with various embodiments.

In various embodiments, as shown in FIG. 11*b*, the upper region 212*a* of the perimeter wall 210 may define an expandable opening 236. In various embodiments, the expandable opening 236 may be an expandable cinch opening, drawstring opening, roll top opening, and/or the like. In various embodiments, expandability of the upper region 212*a* of the perimeter wall 210 may be advantageous, allowing for storage of items for any kind of outdoor objective, and for any purpose. In various embodiments, expandability of the upper region 212*a* of the perimeter wall 210 may be advantageous, allowing for storage of bulky gear items, such as helmets, beverages, sleeping bags, and the like. In various embodiments, the perimeter wall 210 defining the expandable opening 236 may enable access to contents stored within the pack body 204.

Figure 11C:
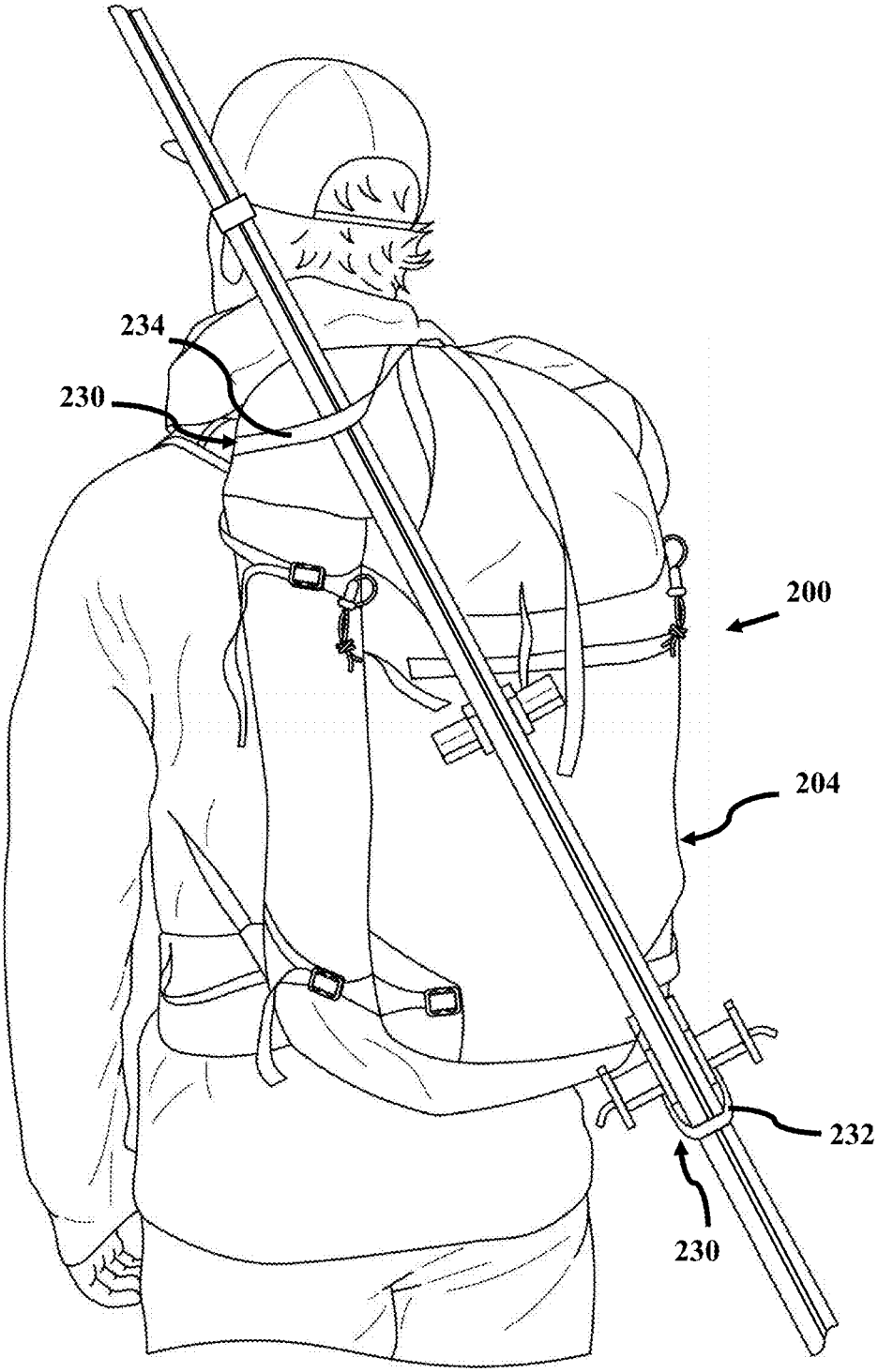
FIG. 11*c* illustrates a perspective view of a diagonal ski carry system on the ultralight backcountry backpack, as worn by a wearer, in accordance with various embodiments.

As further shown in FIGS. 11*a-c*, in various embodiments, the ultralight backcountry backpack 200 may further include a diagonal ski carry system 230. For example, FIG. 11*c* illustrates a perspective view of the diagonal ski carry system 230 on the ultralight backcountry backpack 200, as worn by a wearer, in accordance with various embodiments.

As shown in FIGS. 11*a-c*, the diagonal ski carry system 230 may include a loop 232 attached at the front wall 208 proximal the basal region 212*b* of the perimeter wall 210, and a strap 234 diagonally distal the loop 232 and attached to the upper region 212*a* of the perimeter wall 210.

In various embodiments, the strap 234 may further include a fastening means for removably coupling to a corresponding member 237 at the back wall 206 proximal the upper region 212*a* of the perimeter wall 210. The fastening means may be a hoop, clasp, buckle, clip, catch, hook, tie, pin lock, and the like. In various embodiments, the corresponding member 237 may be a hoop, clasp, buckle, clip, catch, hook, tie, pin lock, and the like. In one exemplary embodiment, the strap 234 may be removably coupled to the corresponding member 237 at the back wall 206 proximal the upper region 212*a*. In various embodiments, a user may pass ski(s) through the loop 232, wrapping the loop 232 around the skis. The user may pull the strap 234, wrapping the strap 234 around the ski(s) and coupling the strap 234 to the corresponding member 237. Together, the loop 232 and strap 234 strap may be wrapped around a ski(s), securing the ski(s).

Accordingly, in various embodiments, the diagonal ski carry system 230 may allow a ski(s) to be removably secured to the backcountry backpack 200. Therefore, in some aspects, the front wall 208 of the pack body 204 may interface with a ski(s). In various embodiments, the diagonal ski carry system disclosed herein may secure a ski(s) to the backcountry backpack 200 in any desirable orientation, be it vertical, diagonal, or horizontal.

Figure 12A:
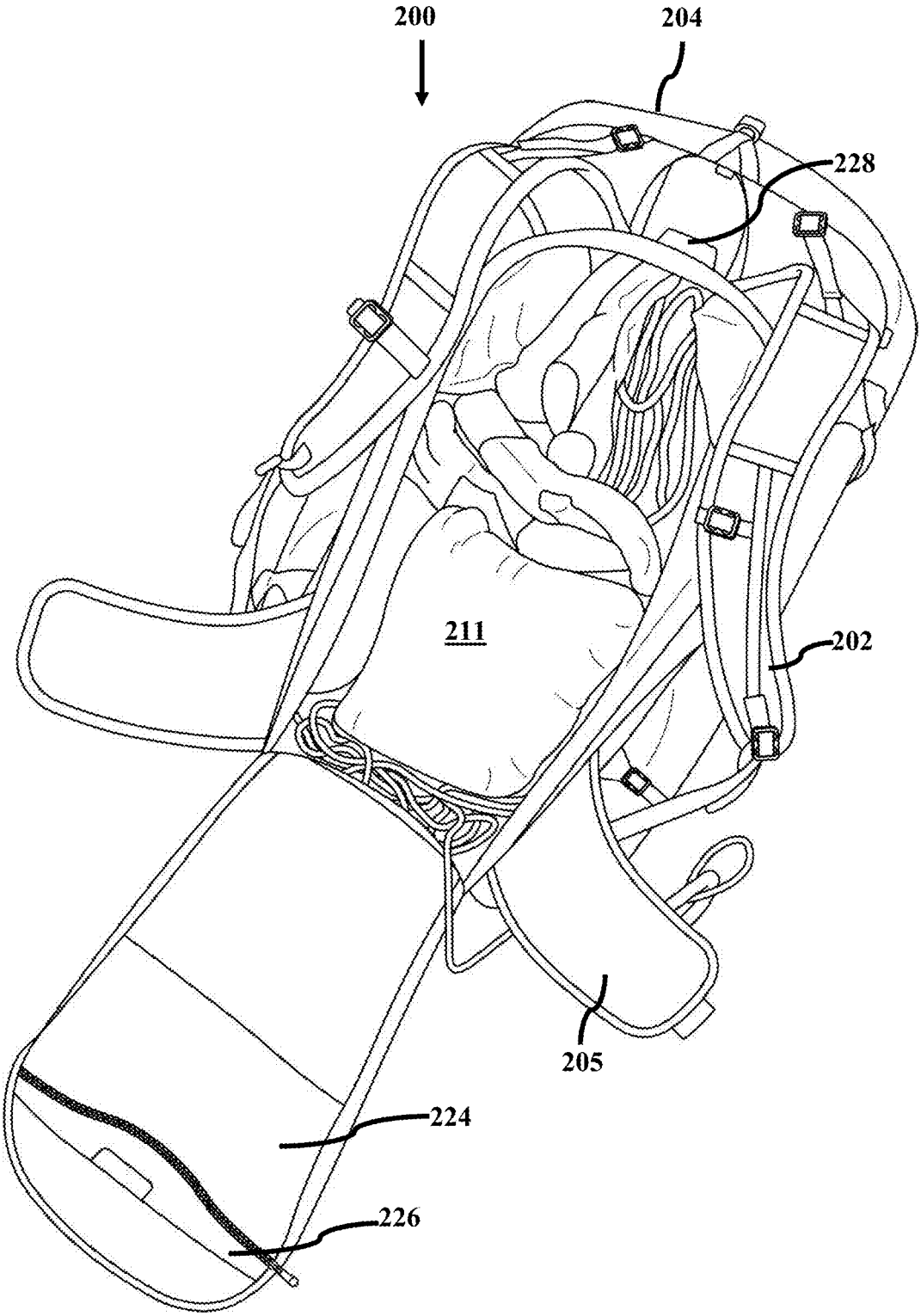
FIG. 12A illustrates a perspective view of the ultralight backcountry backpack when open, in accordance with various embodiments.

Referring to FIG. 12A, and in continued reference to FIGS. 9-11*c*, as shown, the back wall 206, front wall 208, and perimeter wall 210 may define an interior storage compartment 211 (illustrated in FIG. 12A). As shown in FIG. 12A, the interior storage compartment 211 may allow a user to store gear, and other items. In various embodiments, the interior storage compartment 211 may be large enough to accommodate multiple pieces of gear at once, such as for example, long probe(s), shovel(s), snow glove(s), radio(s), rope(s), snack(s), a helmet, a hydration bladder, an air supply apparatus, and the like.

In various embodiments, the interior storage compartment 211 may be revealed or accessed by opening the back wall zipper 207 of the back wall 206. FIG. 12A shows part of the back wall 206 in an "open" position, in accordance with various embodiments. As shown, the back wall 206 may include an interior surface 224 defining a back panel pocket 226. In various embodiments, the back panel pocket 226 may include a fastening means, such as a zipper fastener, hook and loop fastener, and the like. In various embodiments, the back panel pocket 226 may be accessed by opening and closing the fastening means. In various embodiments, the back panel pocket 226 may be an open pocket.

In some aspects, the back panel pocket 226 may receive and store a removable back panel sheet. When not in use, the back panel sheet may be removed from the pack body 204 to reduce the weight of the backcountry backpack 200. In various embodiments, the back panel sheet may be removed from the pack body 204 to be used as a cushioning means, such as, for example, a knee pad, a seat, and the like. In various embodiments, the back panel sheet may be removed from the pack body 204 to be used for first aid, such as, for example, splinting a patient, separating a patient from the snow while awaiting rescue, and the like.

In various embodiments, the back panel sheet may be, for example, a polyethylene foam sheet. In various embodiments, the back panel sheet may be made of any padded or blown thermoplastic material having a dimensional stability and recovery characteristic that provides cushioning, shock-absorption, and stability on impact.

As further shown in FIG. 12A, the back wall 206 may define at least one port 228 proximal the upper region 212*a* of the perimeter wall 210 of the pack body 204. In various embodiments, the port 228 may allow access to a piece of equipment or gear, allowing such piece of equipment or gear to pass therethrough. For example, the port 228 may allow access to at least one of an air-supply mouthpiece and a hydration tube mouthpiece. Access to an air-supply mouthpiece may be beneficial in the event of an avalanche or snow collapse in which the user is buried under the snow. Without taking the backpack 200 off, the user may be able to access the air-supply mouthpiece at the port 228. Likewise, access to a hydration tube at the port 228 may reduce the inconvenience of doffing and donning the backcountry backpack 200, giving the user near immediate access to water (or other liquids) when needed.

In some aspects, providing further support and structure to the pack body 204, the pack body 204 may include a removable frame within the interior storage compartment 211. In various embodiments, the removable frame may assist in distributing weight evenly across a user's back and hips. In some aspects, the removable frame may extend along the perimeter wall 210 (e.g., a circumference of the interior storage compartment 211), thereby following the pack body's shape and structure. In various embodiments, the removable frame may assist the user in carrying heavier loads for greater periods of time. In some aspects, a user may determine that the frame is not needed, and may elect to remove the frame, thereby further reducing the overall weight of the backcountry backpack 200.

In some aspects, interior surfaces of the back wall 206, front wall 208, and perimeter wall 210 may further define a tool storage apparatus within the interior storage compartment 211. The tool storage apparatus, which will be described in further detail in reference to the backcountry backpack 200 embodiment shown in FIGS. 13A-D, may comprise at least one sleeve capable of storing items, such as gear. In various embodiments, the tool storage apparatus may store items that a user may need on short notice in the backcountry, such as an avalanche probe and/or shovel. The tool storage apparatus may cordon off the gear stored therein from the rest of the contents stored within other parts of the interior storage compartment 211. This may be desirable if the contents stored in the sleeves, such as gear, gets wet when being used. Accordingly, storing such contents in the tool storage apparatus may help reduce the likelihood of the other backcountry backpack contents getting wet.

Moreover, a user may want to reach their gear on a moment's notice whether for convenience or emergency purposes, or the environment may prevent the user from taking off the backpack 200 to reach stored items. Indeed, it may be advantageous for the user to reach items stored in the tool storage apparatus without having to take off the backpack 200 or open the back wall zipper 207.

Referring to FIGS. 12B-F, a tool storage apparatus may be accessible by one or more zippers located on the pack body 204. Each zipper may allow access to a corresponding sleeve within the interior storage compartment 211. In various embodiments, the zippers may allow a user to reach contents stored in a tool storage apparatus within the interior storage compartment 211 either when the backcountry backpack 200 is being worn, or when the user slings the backpack 200 over an arm and rotates the backpack 200 to reach the zippers.

Figure 12B:
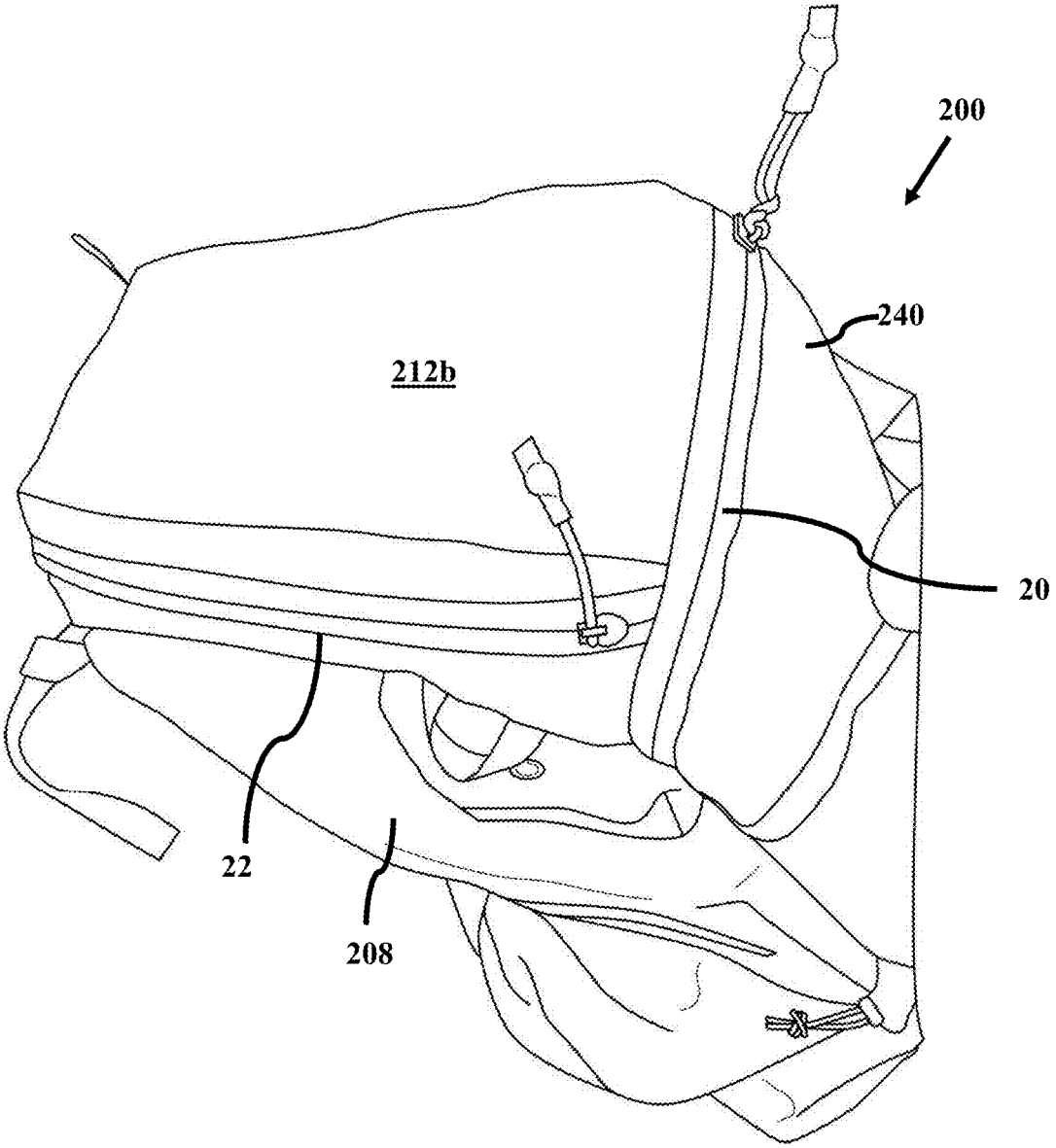
FIG. 12B illustrates a perspective view of a portion of the ultralight backcountry backpack, in accordance with various embodiments.
Figure 12C:
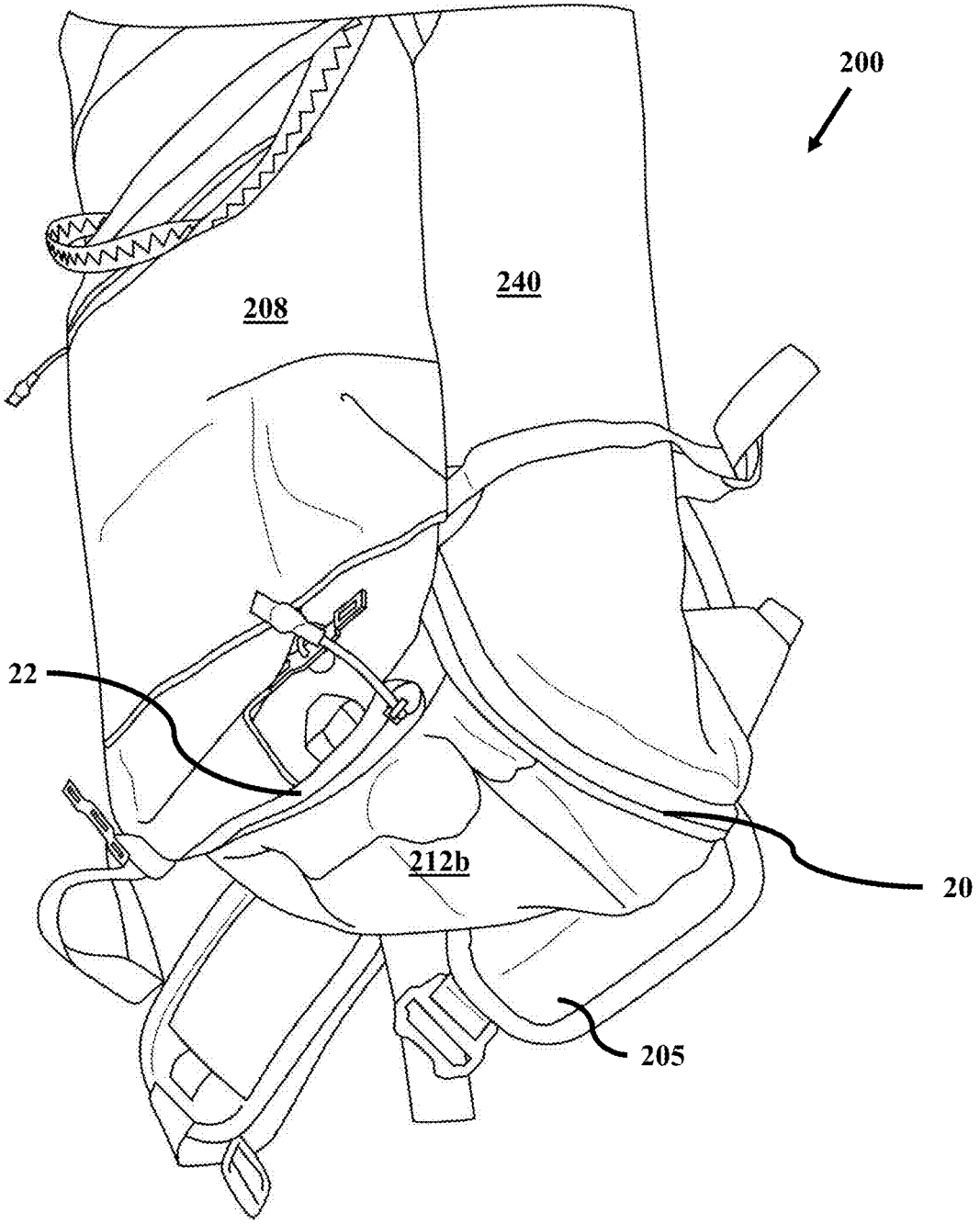
FIG. 12C illustrates a perspective view of a portion of the ultralight backcountry backpack, in accordance with various embodiments.
Figure 12D:
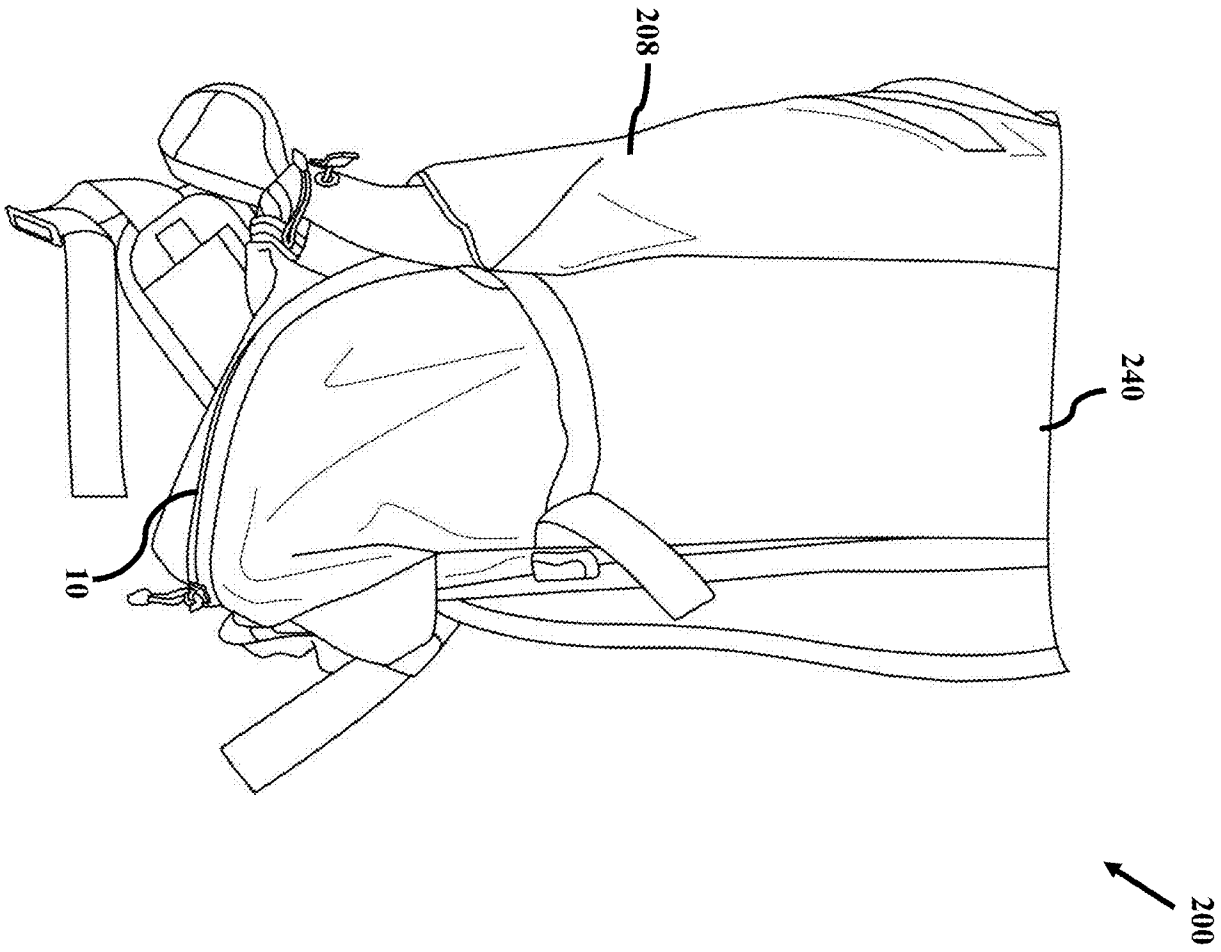
FIG. 12D illustrates a side view of a portion of the ultralight backcountry backpack, in accordance with various embodiments.
Figure 12E:
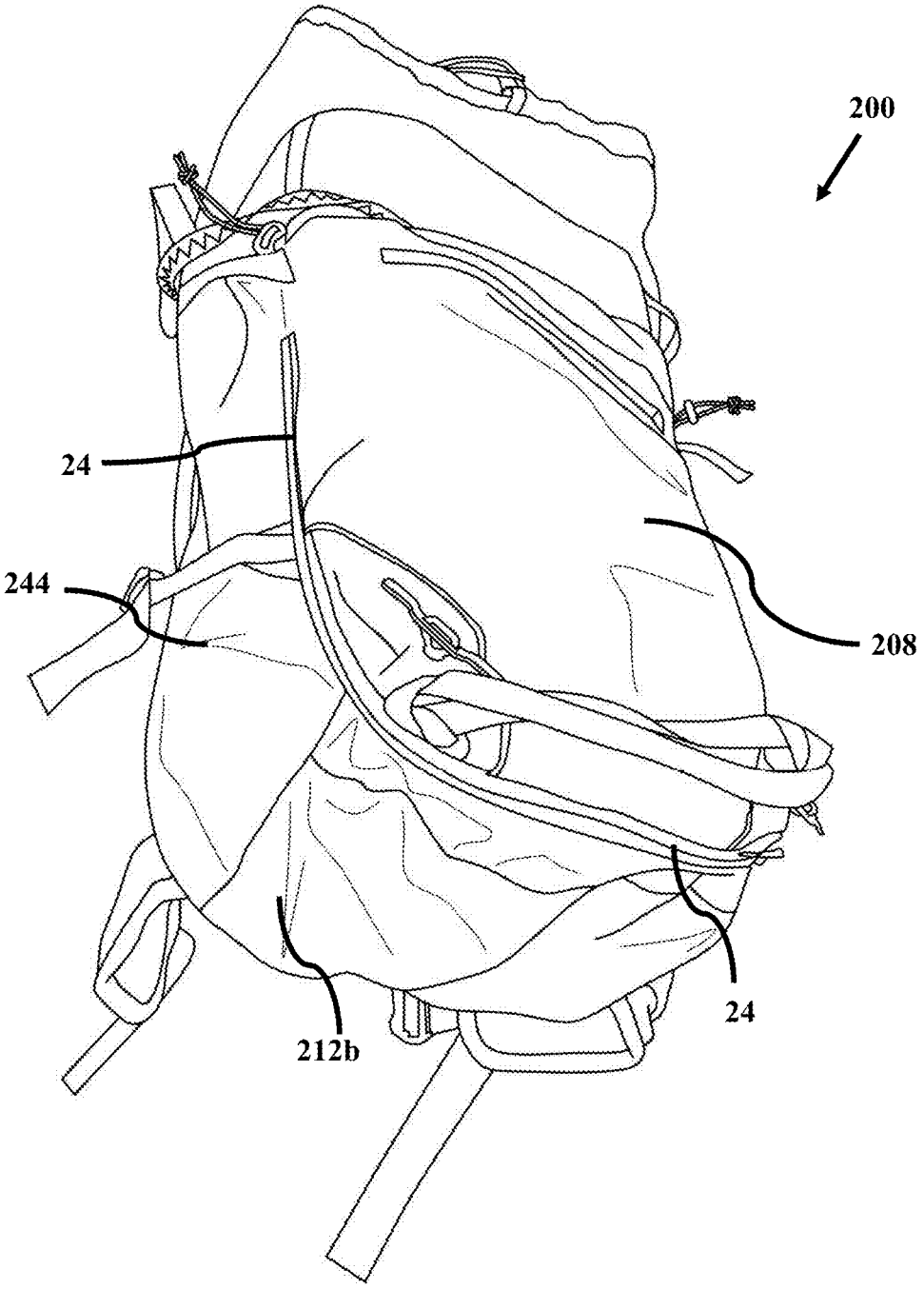
FIG. 12E illustrates a perspective view of the ultralight backcountry backpack, in accordance with various embodiments.
Figure 12F:
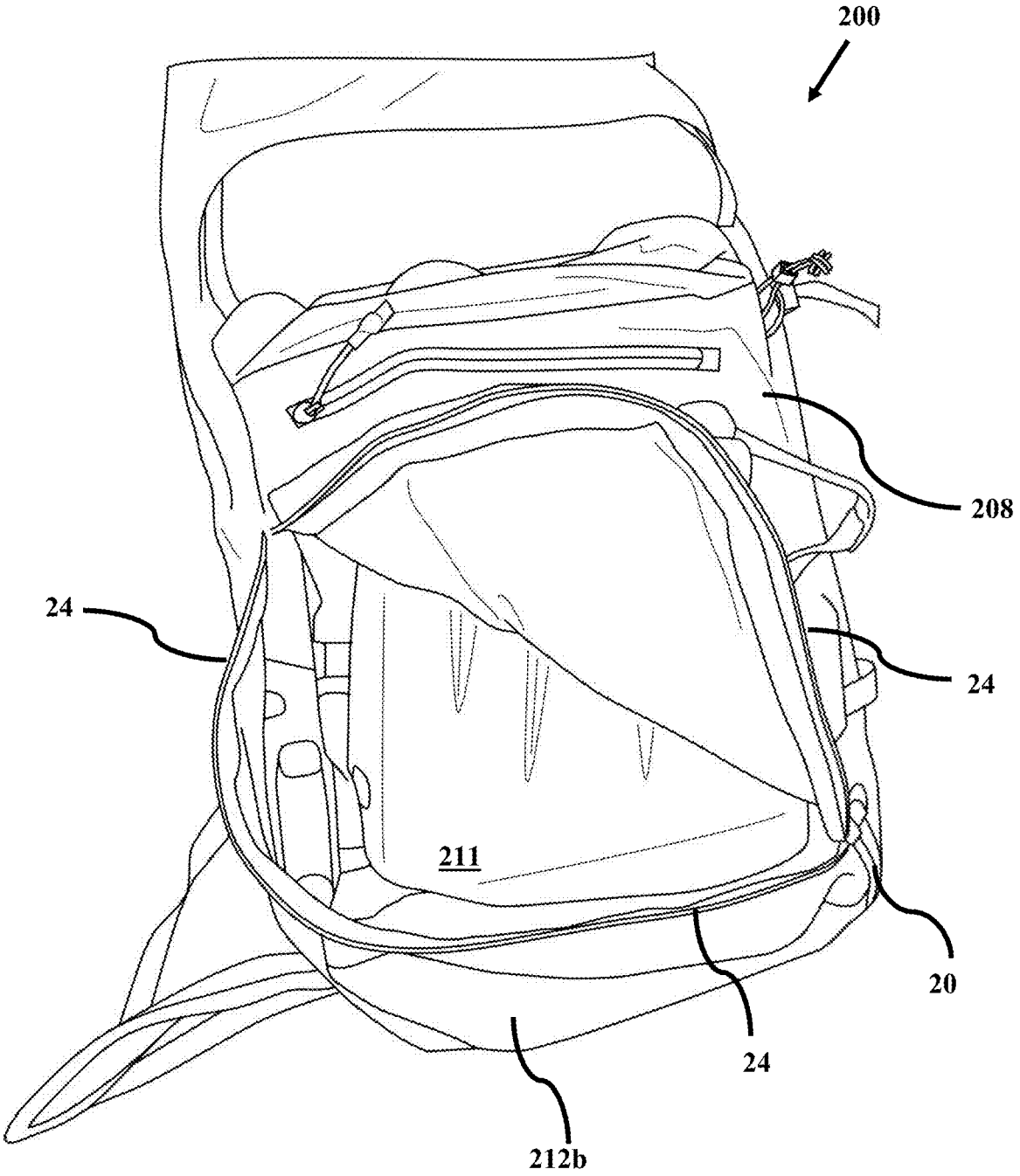
FIG. 12F illustrates a perspective view of the ultralight backcountry backpack when open, in accordance with various embodiments.

For example, FIGS. 12B-D illustrate perspective and side views of an exemplary embodiment of the backcountry backpack 200 of the present disclosure and FIGS. 12E-F illustrate perspective views of an alternative exemplary embodiment of the backcountry backpack 200 of the present disclosure.

As shown, the backcountry backpack 200 of FIGS. 12B-D may include a first lateral region zipper 20 and a base zipper 22. The first lateral region zipper 20 may be located proximately between the basal region 212*b* and the first lateral region 240 of the perimeter wall 210 and may extend perpendicularly between the back wall 206 and front wall 208. The base zipper 22 may be located proximately between the front wall 208 and the basal region 212*b* of the perimeter wall 210 and may extend perpendicularly between the first lateral region 240 and the second lateral region 244.

In the alternative embodiment of FIGS. 12E-F, the backcountry backpack 200 may include the first lateral region zipper 20 and a perimeter wall zipper 24. As shown, the perimeter wall zipper 24 may trace a portion of a perimeter of the front wall 208. The perimeter wall zipper 24 may be located proximately between the front wall 208 and the basal region 212*b* of the perimeter wall 210 and between the front wall 208 and the second lateral region 244 of the perimeter wall 210. Accordingly, the perimeter wall zipper 24 may be an L-shaped zipper, matching the curved outline of the pack body 204. FIG. 12F illustrates the perimeter wall zipper 24 in an 'open' position, revealing the contents stored within the interior storage compartment 211 of the pack body 204 of the backpack 200.

In either of the embodiments shown in FIGS. 12B-F, a user wearing the ultralight backcountry backpack 200 may reach behind and/or to their side to manipulate the first lateral region zipper 20, the base zipper 22, and/or the perimeter wall zipper 24, opening and closing the zippers 20-24 to remove or stow items, such as gear. The zippers 20-24 may be of the same or different lengths and widths, accommodating a variety of items. As shown and in accordance with various embodiments, the first lateral region zipper 20 may be smaller in length than either of the base zipper 22 or perimeter wall zipper 24. The perimeter wall zipper 24 may be larger in length than either of the base zipper 22 or first lateral region zipper 20.

In various embodiments, for example, the first lateral region zipper 20 may allow user access to an avalanche probe and/or a shovel rod (a shovel rod may include a shovel handle). In various embodiments, the base zipper 22 or perimeter wall zipper 24 may allow user access to a shovel blade. In various embodiments, the zippers 20-24 may enable user access directly into the interior storage compartment 211 and/or directly into a tool storage apparatus defined by the back wall 206, front wall 208, and perimeter wall 210.

FIGS. 13A-D illustrate another alternative exemplary embodiment of the backcountry backpack 200 of the present disclosure. As shown, the backcountry backpack 200 may include a tool storage apparatus 220 within the interior storage compartment 211. Moreover, FIGS. 13A-D illustrate perspective and top-down views of the tool storage apparatus 220 and interior storage compartment 211 of the backcountry backpack 200, in accordance with various embodiments.

Figure 13A:
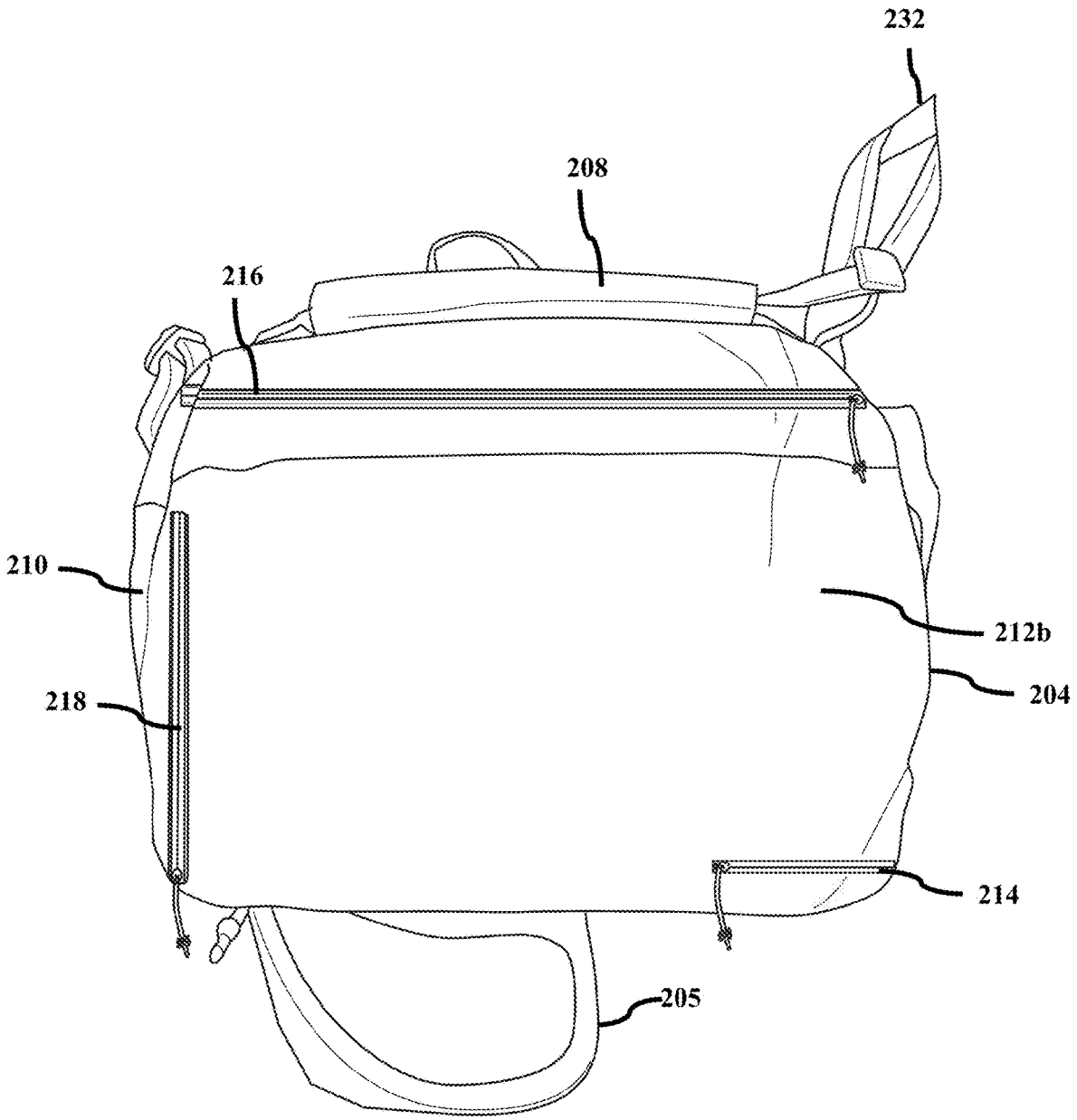
FIG. 13A illustrates a perspective view of a basal region of the ultralight backcountry backpack, in accordance with various embodiments.

As shown in FIG. 13A, the basal region 212*b* may include a probe zipper 214, a shovel blade zipper 216, and a shovel rod zipper 218. These zippers 214-218 at the basal region 212*b* may allow the user to access the interior storage compartment 211 of the pack body 204. In various embodiments, this accessibility (e.g., reaching down to the basal region 212*b*) may allow a user the ability to access contents stored within the interior storage compartment 211 without the need for doffing and donning the backpack, or otherwise rearranging the contents stored within the interior storage compartment 211. In various embodiments, the probe zipper 214, shovel blade zipper 216, and shovel rod zipper 218 may each allow a user the ability to quickly access tools critical to managing and surviving the backcountry, avalanche tools, without the need for doffing and donning the backpack, or otherwise rearranging the contents stored within the interior storage compartment 211. Specifically, the zippers 214-218 may allow a user quick access to a long probe and shovel components (blade and rod).

Each of the zippers 214-218 may be arranged in any desirable orientation at the basal region 212*b* and may be of the same or different lengths and widths. As shown and in accordance with various embodiments, of the three zippers, the probe zipper 214 may be most proximal the first lateral region 240 at where the first lateral region 240 of the perimeter wall 210 is connected to the back wall 206. Moreover, as shown and in accordance with various embodiments, of the three zippers, the shovel blade zipper 216 may be most proximal the front wall 208. Moreover, as shown and in accordance with various embodiments, of the three zippers, the shovel rod zipper 218 may be most proximal the second lateral region 244, extending from a point where the second lateral region 244 of the perimeter wall 210 is connected to the back wall 206 to a point where the second lateral region 244 of the perimeter wall 210 is connected to the front wall 208.

In various embodiments, the probe zipper 214 may be substantially parallel to the back wall 206. In other embodiments, the probe zipper 214 may be substantially perpendicular to the back wall 206. In various embodiments, the shovel blade zipper 216 may be substantially parallel to the front wall 208. In other embodiments, the shovel blade zipper 216 may be substantially perpendicular to the front wall 208. In various embodiments, the shovel rod zipper 218 may be substantially perpendicular to the back wall 206 and front wall 208. In various embodiments, the shovel rod zipper 218 may be substantially parallel to the back wall 206 and the front wall 208. In other embodiments, the probe zipper 214 may be substantially perpendicular to the back wall 206.

Figure 13B:
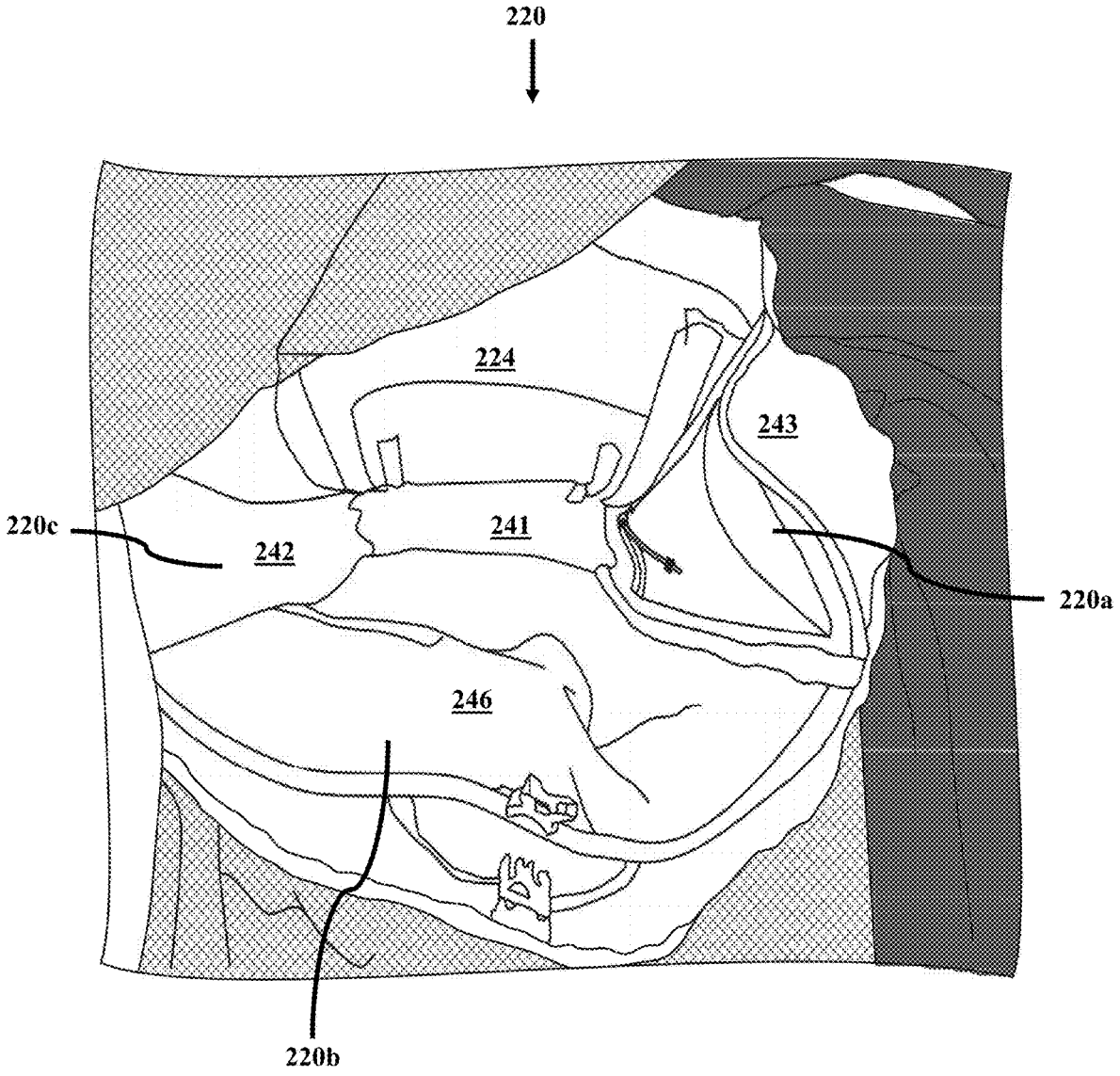
FIG. 13B illustrates a top-down view of a portion of an interior storage compartment of the ultralight backcountry backpack's, in accordance with various embodiments.
Figure 13C:
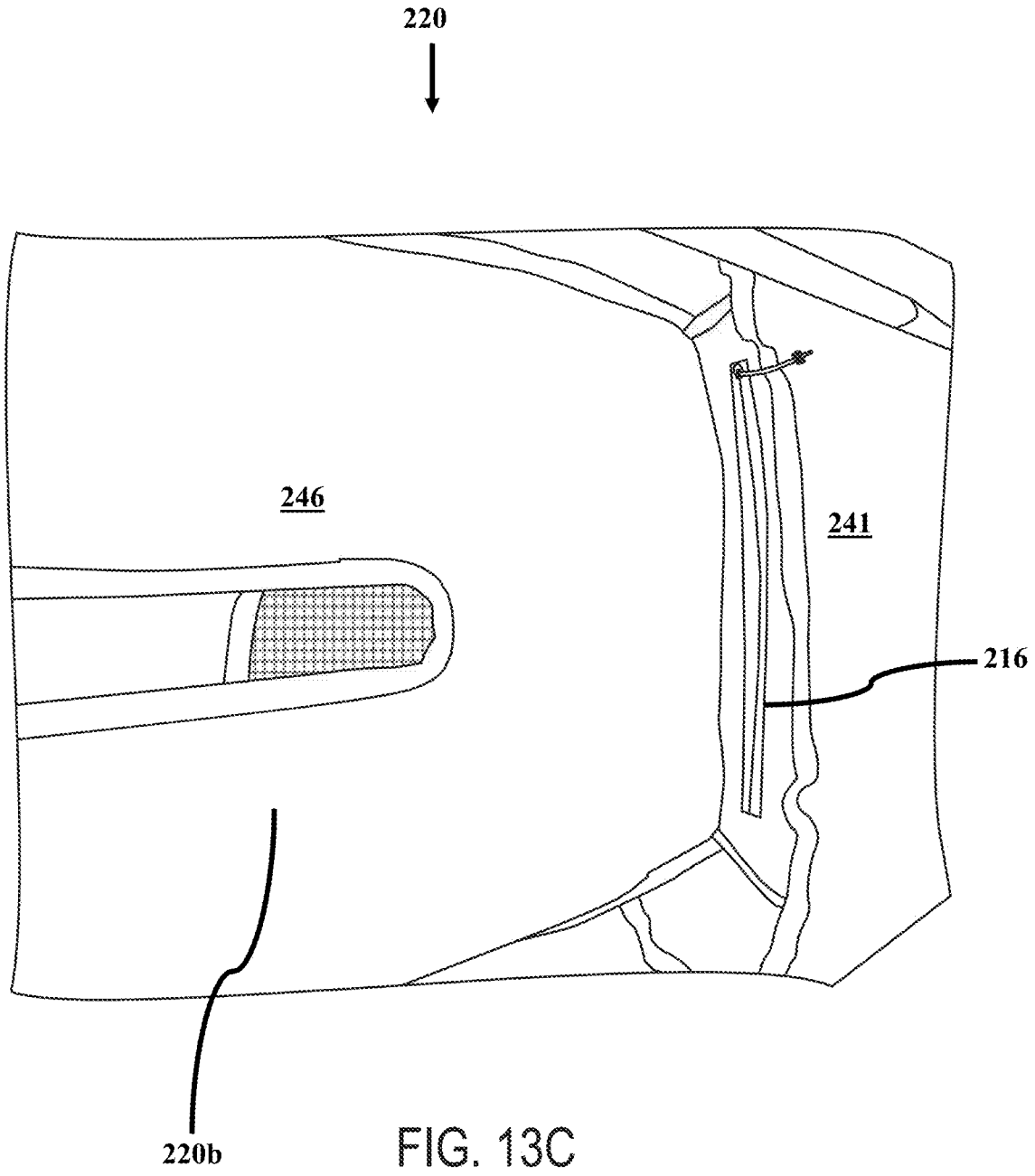
FIG. 13C illustrates a perspective view of a portion of the ultralight backcountry backpack's interior storage compartment, in accordance with various embodiments.
Figure 13D:
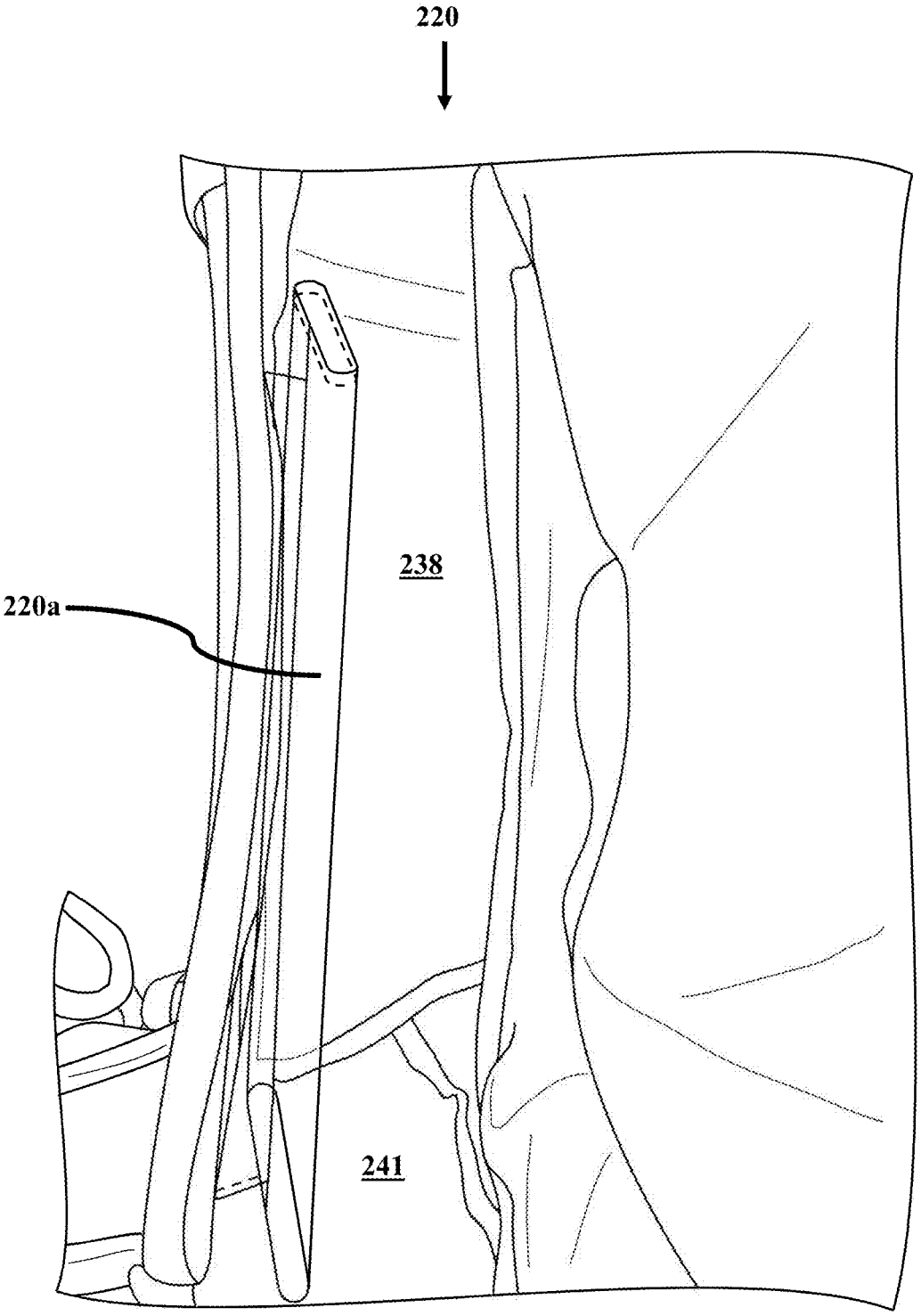
FIG. 13D illustrates a perspective view of a portion of the ultralight backcountry backpack's interior storage compartment, in accordance with various embodiments.

In various embodiments, the probe zipper 214, shovel blade zipper 216, and shovel rod zipper 218 may allow a user access to the tool storage apparatus 220 within the interior storage compartment 211. As shown in FIGS. 13B-D, the tool storage apparatus 220 may include a probe sleeve 220*a*, a shovel blade sleeve 220*b*, and a shovel rod sleeve 220*c*. The inventor has contemplated that the sleeves described herein may be applicable to any of the embodiments of the ultralight backcountry backpack of the present disclosure.

Each of the probe sleeve 220*a*, shovel blade sleeve 220*b*, and shovel rod sleeve 220*c* may be accessible at the basal region 212*b* by opening and closing corresponding probe zipper 214, shovel blade zipper 216, and shovel rod zipper 218.

FIGS. 13B-13D illustrate the tool storage apparatus 220 and interior storage compartment 211 of the backpack 200, in accordance with various embodiments. As shown in FIGS. 13B and 13D, in various embodiments, the probe sleeve 220*a* may be defined by an interior surface 243 of the first lateral region 240 of the perimeter wall 210 and an interior surface 241 of the basal region 212*b*. In various embodiments, the probe zipper 214 may interface with the interior surface 241 of the basal region 212*b*, giving a user access to the probe sleeve 220*a* (shown in FIGS. 13B and 13D) at the basal region 212*b*.

Moreover, as shown in FIGS. 13B and 13C, in various embodiments, the shovel blade sleeve 220*b* may be defined by an interior surface 246 of the front wall 208 and the interior surface 241 of the basal region 212*b*. In various embodiments, the shovel blade zipper 216 may interface with the interior surface 241 of the basal region 212*b*, giving a user access to the shovel blade sleeve 220*b* (FIGS. 12B and 12C) at the basal region 212*b*.

Moreover, as shown in FIG. 13B, in various embodiments, the shovel rod sleeve 220*c* may be defined by an interior surface 242 of the second lateral region 244 of the perimeter wall 210 and the interior surface 241 of the basal region 212*b*. In various embodiments, shovel rod zipper 218 may interface with the interior surface 241 of the basal region 212*b*, giving a user access to the shovel rod sleeve 220*c* (FIG. 13B) at the basal region 212*b*.

In various embodiments, the probe sleeve 220*a*, shovel blade sleeve 220*b*, and shovel rod sleeve 220*c* of the tool storage apparatus 220 may cordon off the avalanche tools (long probe and shovel) off from the rest of the contents of the interior storage compartment 211. This may be desirable if the avalanche tools get wet when being used. Accordingly, storing such contents in the sleeves 220*a*-220*c* may help reduce the likelihood of the other backpack contents getting wet.

In addition, the structure of the sleeves 220*a-c* (each defined from the interior surface 241 of the basal region 212*b*), may allow the user direct access to the tools stored in the sleeves 220*a*-220*c* by opening and closing the corresponding zippers 214-218, thereby leaving the rest of backpack contents largely undisturbed when opening and closing the zippers 214-218.

The tool storage apparatus 220 of the ultralight backcountry backpack 200 may enable quick, efficient, neat, and convenient access to all manner of tools stored in the tool storage apparatus 220, without the need to doff and don the backpack 200 or otherwise disturb the rest of the backpack's contents. Indeed, many users of the backpack 200, especially those who venture into the great outdoors, may want to maximize the space allowed for storing items in the interior storage compartment 211 (as well as other areas of the backpack 200) and may therefore spend considerable time initially packing items in the backpack 200. Repeatedly donning and doffing the backpack to open the backpack to remove (and re-store) items may disrupt a user's meticulous and organized arrangement of items within the backpack 200 and may lead to gear loss as gear is repeatedly removed and strewn across the landscape. Worse, poor accessibility and repeated donning and doffing may compromise user safety in the event the user needs to reach a tool quickly and does not have time to remove the backpack. This is especially problematic when the user risks losing the backpack itself, along with the user's hydration and air-supply sources, due to repeated doffing.

Accordingly, the tool storage apparatus 220 may be beneficial to users who may need (or may conveniently want) stored contents and/or their most important contents at a moment's notice. In various embodiments, the storage apparatus 220 may be beneficial to users who do not want to get the ultralight backcountry backpack 200 (or its other contents) wet and/or dirty unnecessarily, and who want to avoid the arduous task of repeatedly rearranging the contents within the backpack 200, saving time, energy, and in some cases where damage from the elements is prevented, money.

Figure 14:
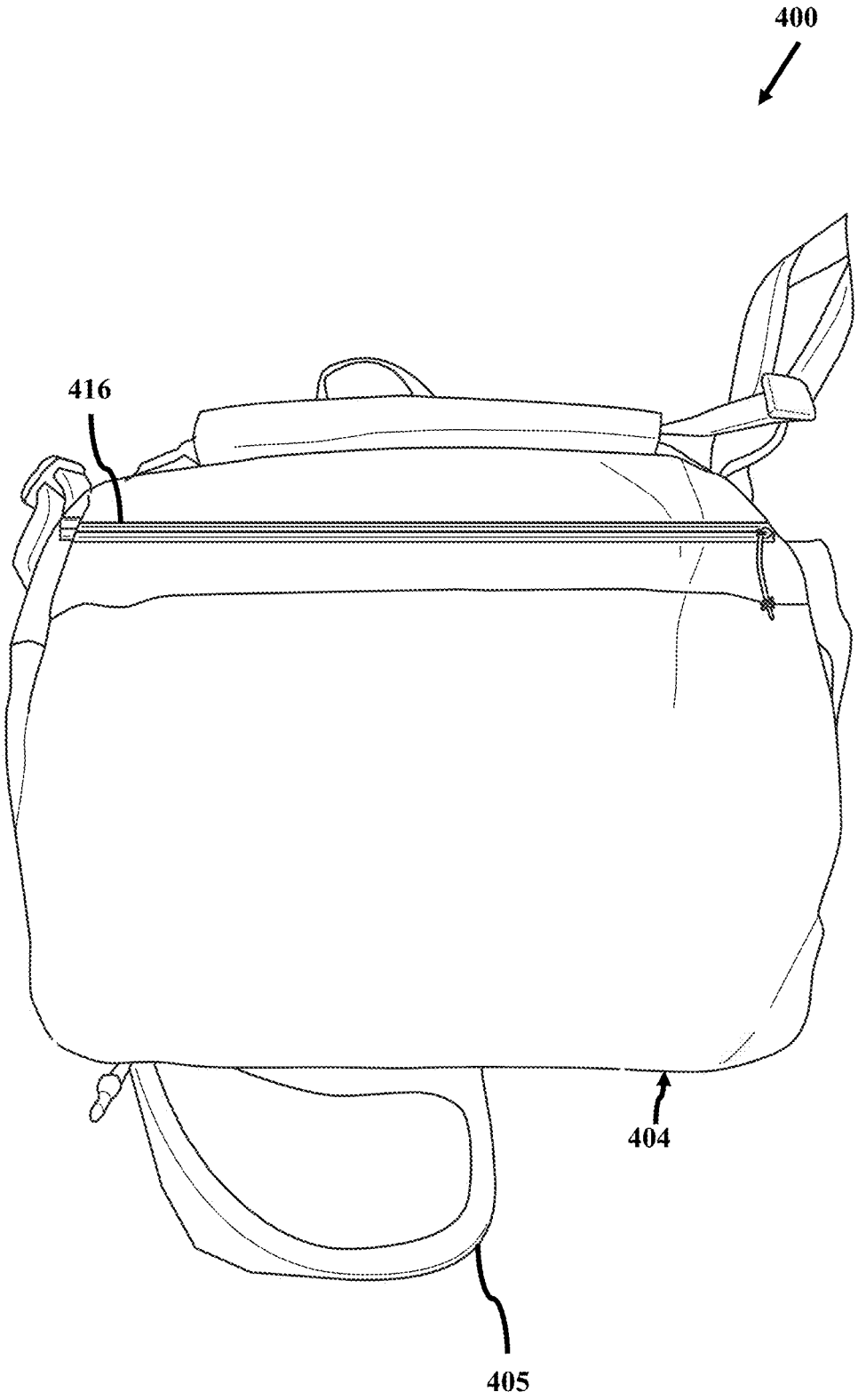
FIG. 14 illustrates a perspective view of an ultralight backcountry backpack, in accordance with various embodiments.

FIG. 14 illustrates a perspective view of a portion of an ultralight backcountry backpack 400, in accordance with various embodiments. As shown, the backpack 400 may include a pack body 404 and a hip pad 405. As shown, the backpack 400 may include just one shovel blade zipper 416 on the pack body 404. The shovel blade zipper 416 may allow a user access to a shovel blade stored within the pack body 404 at a basal region of the pack body 404, allowing the user the ability to withdraw and store the shovel blade within the pack body 404 without the need to doff and don the backpack 400.

Figure 15:
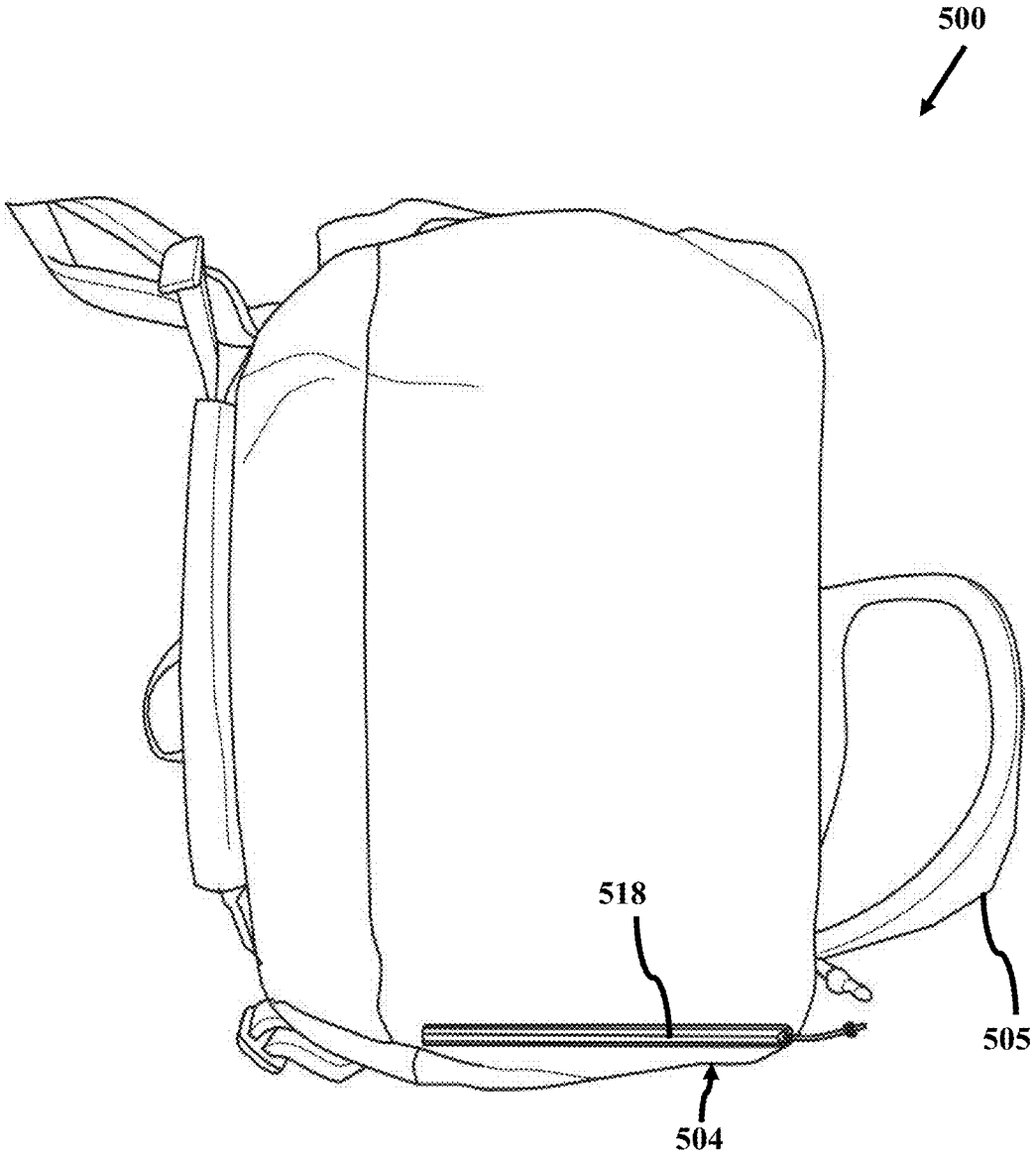
FIG. 15 illustrates a perspective view of an ultralight backcountry backpack, in accordance with various embodiments.

FIG. 15 illustrates a perspective view of a portion of an ultralight backcountry backpack 500, in accordance with various embodiments. As shown, the backpack 500 may include a pack body 504 and a hip pad 505. As shown, the backpack 500 may include just one shovel rod zipper 518 on the pack body 504. The shovel rod zipper 518 may allow a user access to a shovel rod stored within the pack body 504 at a basal region of the pack body 504, allowing the user the ability to withdraw and store the shovel rod within the pack body 504 without the need to doff and don the backpack 500.

Figure 16:
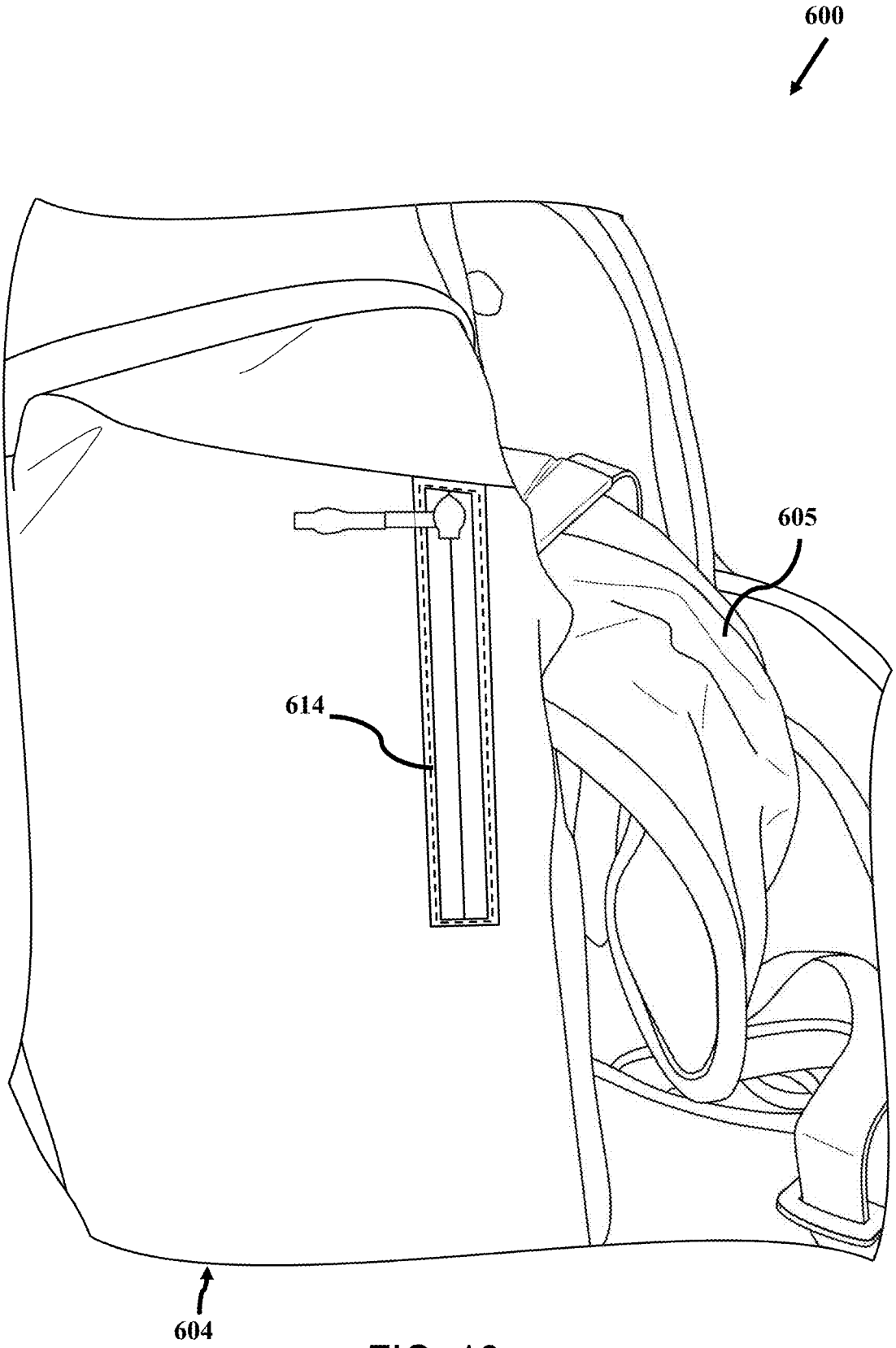
FIG. 16 illustrates a perspective view of an ultralight backcountry backpack, in accordance with various embodiments.

FIG. 16 illustrates a perspective view of a portion of an ultralight backcountry backpack 600, in accordance with various embodiments. As shown, the backpack 600 may include a pack body 604 and a hip pad 605. As shown, the backpack 600 may include just one probe zipper 614 on the pack body 604. The probe zipper 614 may allow a user access to a probe stored within the pack body 604 at a basal region of the pack body 604, allowing the user the ability to withdraw and store the probe within the pack body 604 without the need to doff and don the backpack 600.

Figure 17:
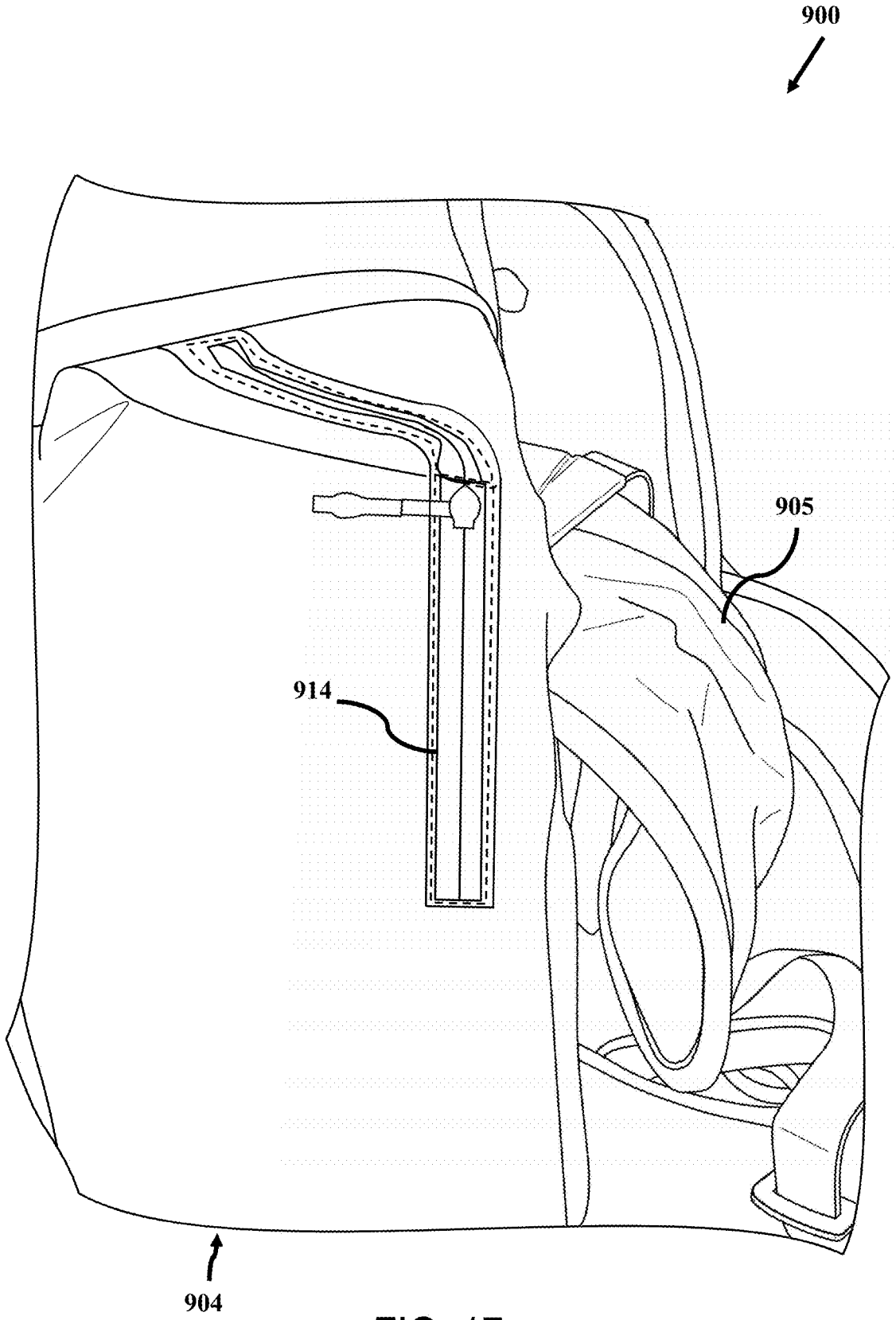
FIG. 17 illustrates a perspective view of an ultralight backcountry backpack, in accordance with various embodiments.

FIG. 17 illustrates a perspective view of a portion of an ultralight backcountry backpack 900, in accordance with various embodiments. As shown, the backpack 900 may include a pack body 904 and a hip pad 905. As shown, the backpack 900 may include a zipper 914 extending from a basal region of the pack body 904 to a lateral region of the pack body 904. In various embodiments, the backpack 900 may include just one lateral region zipper 914 on the pack body 904. As shown, the zipper 914 may allow a user access to contents within the pack body 904 at both the basal and lateral regions of the pack body 904, allowing the user the ability to withdraw and store items within the pack body 904 without the need to doff and don the backpack 900. In various embodiments, the pack body 904 may include just one lateral region zipper that allows allow a user access to contents within the pack body 904 at the lateral region of the pack body 904, allowing the user the ability to withdraw and store items within the pack body 904 without the need to doff and don the backpack 900.

Figure 18:
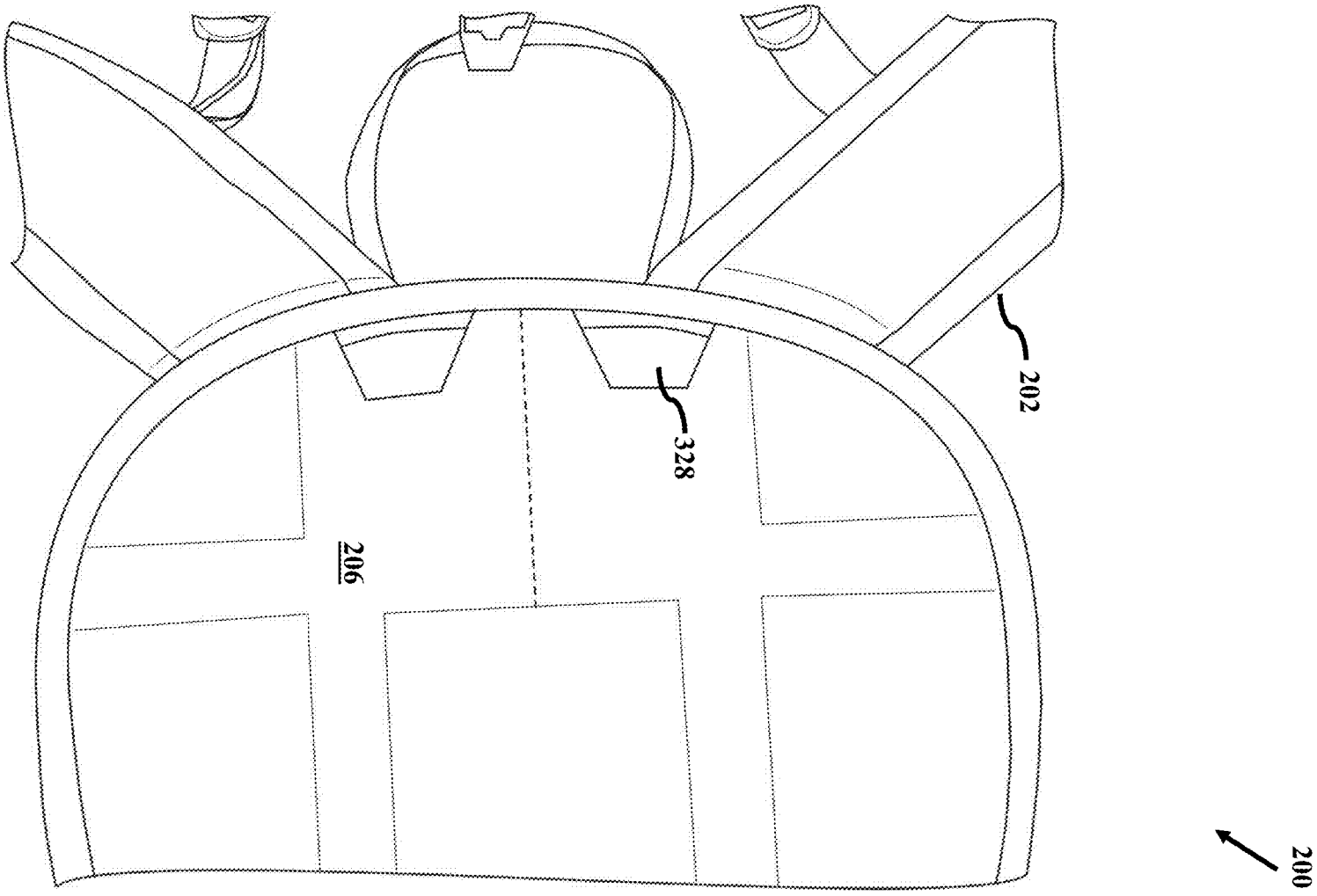
FIG. 18 illustrates a perspective view of the ultralight backcountry backpack of FIGS. 9-13D, in accordance with various embodiments.

FIG. 18 illustrates a perspective view of the ultralight backcountry backpack of FIGS. 9-13D, in accordance with various embodiments. As shown, the back wall 206 may define at least one port 328. As shown and in accordance with various embodiments, the port 328 may be a cutaway port of the back wall 206. The port 328 may be proximal the upper region 212*a* of the perimeter wall 210 of the pack body 204. In various embodiments, the port 328 may allow access to a piece of equipment or gear, allowing such piece of equipment or gear to pass therethrough. For example, the port 328 may allow access to at least one of an air-supply mouthpiece, an air-supply tube, a hydration tube, and/or a hydration tube mouthpiece. Access to an air-supply mouthpiece may be beneficial in the event of an avalanche or snow collapse in which the user is buried under the snow. Without taking the backpack 200 off, the user may be able to access the air-supply mouthpiece at the port 328. Likewise, access to a hydration tube at the port 328 may reduce the inconvenience of doffing and donning the backcountry backpack 200, giving the user near immediate access to water (or other liquids) when needed.

Figure 19:
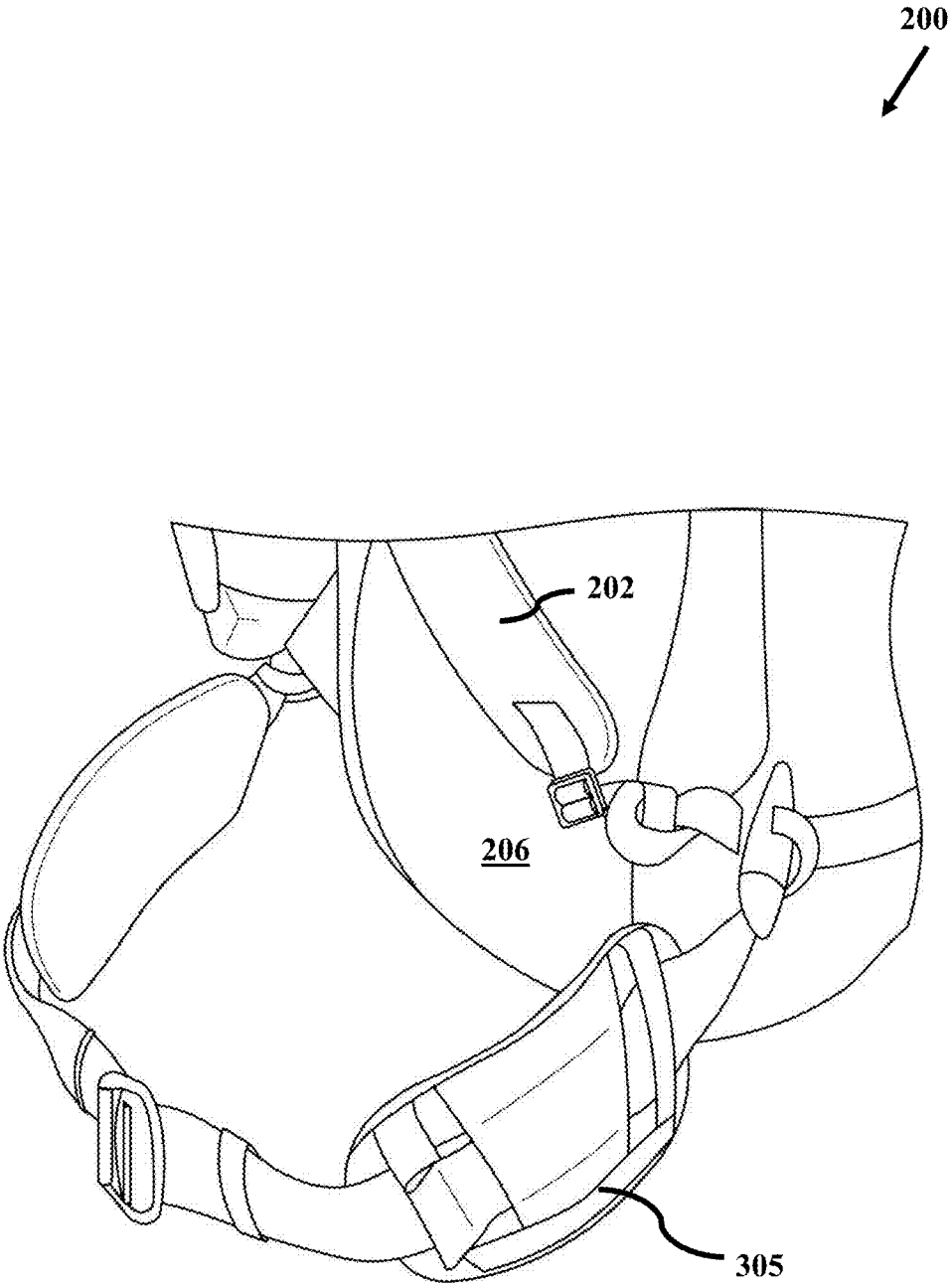
FIG. 19 illustrates a perspective view of a portion of the ultralight backcountry backpack of FIGS. 9-13D with at least one adjustable hip pad, in accordance with various embodiments.
Figure 20A:
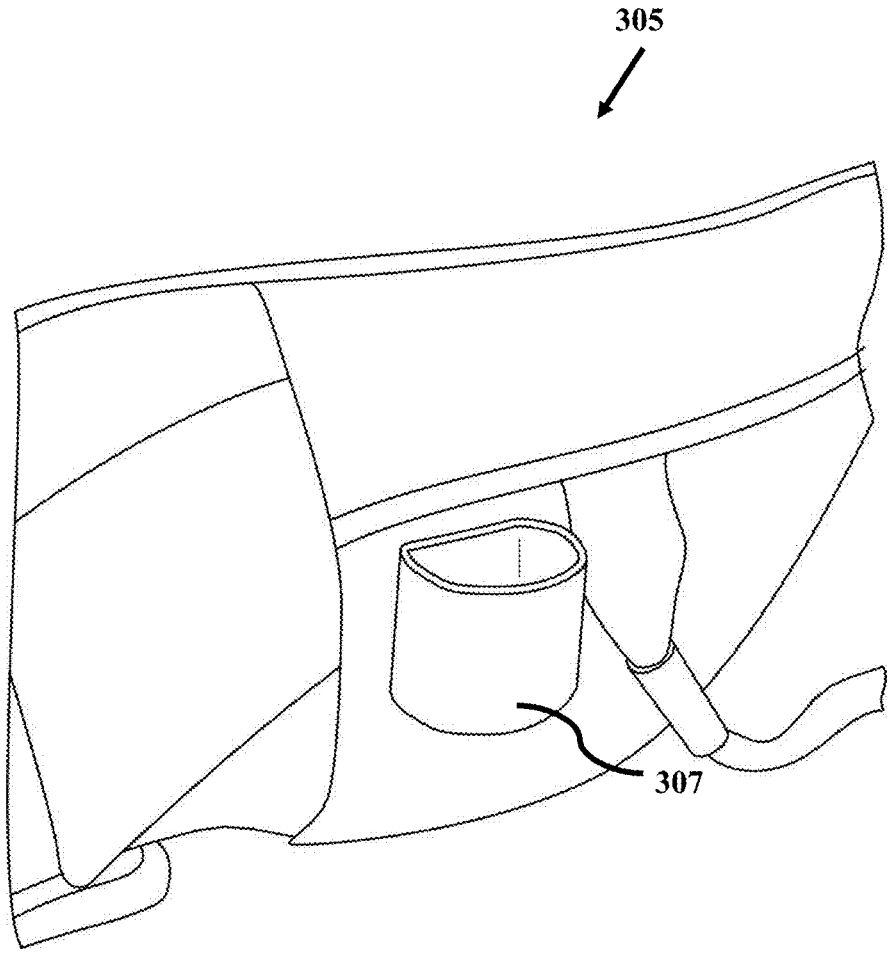
FIG. 20*a* illustrates a perspective view of a portion of the at least one adjustable hip pad of FIG. 19, in accordance with various embodiments.
Figure 20B:
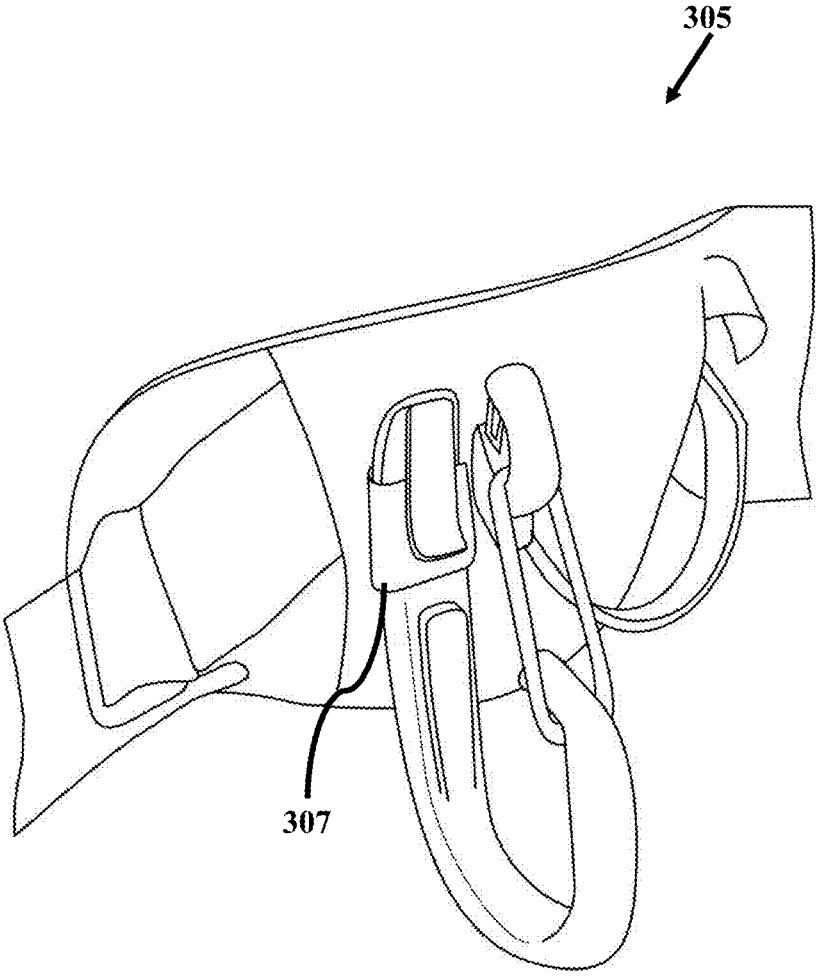
FIG. 20*b* illustrates a perspective view of a portion of the at least one adjustable hip pad of FIGS. 19-20*a*, in accordance with various embodiments.

FIG. 19 illustrates a perspective view of a portion of the ultralight backcountry backpack of FIGS. 9-13D with at least one adjustable hip pad 305, in accordance with various embodiments. In various embodiments, the adjustable hip pad 305 may be a removable slide-on hip pad. FIG. 20*a* illustrates a perspective view of a portion of the hip pad of FIG. 19. As shown, the adjustable hip pad 305 includes an ice clipper receptacle 307. The receptacle 307 may define a slot for receiving ice clipper tools therethrough, allowing a user quick and easy access to ice clippers. For example, FIG. 20*b* illustrates a perspective view of a portion of the hip pad 305 of FIGS. 19-20*a* having ice clipper tools clipped into place in the ice clipper receptacle 307.

Each of the hip pads disclosed herein, in reference to FIGS. 1-20*b* may comprise ice clipper receptacles, may define hip pad pockets for storing items, such as phones, and my otherwise be used for storing items to be within reach of the user.

In some respects, the shoulder strap(s) 202, pack body 204, back wall 206, front wall 208, perimeter wall 210, probe sleeve 220*a*, shovel blade sleeve 220*b*, and shovel rod sleeve 220*c* may be made of the same or different materials. In various embodiments, the ultralight backcountry backpack 200 may be made of woven nylon. In various embodiments, the ultralight backcountry backpack 200 may be made of fabric. In various embodiments, the back wall 206 may include a polyethylene (PE) foam layer. In various embodiments, the backpack 200 (and elements thereof) may be made of, for example, a waterproof fabric. In various embodiments, the backpack 200 (and elements thereof) may be made of, for example, a laminated fabric comprising a polyethylene (PE) fabric, a polyester plain woven face, and a polyethylene terephthalate (PET) film coating. In various embodiments, the backpack 200 (and elements thereof) may be made of, for example, a laminated fabric comprising a polyethylene (PE) fabric, a polyester plain woven face, a crossply, and a polyethylene terephthalate (PET) film coating. In various embodiments, the backpack 200 (and elements thereof) may be made of, for example, a laminated fabric comprising an ultra-high molecular weight polyethylene (UHMWPE) fabric, a polyester plain woven face, a crossply, and a polyethylene terephthalate (PET) film coating. In various embodiments, the backpack 200 (and elements thereof) may further include polyvinyl fluoride (PVF) material. In various embodiments, the backpack 200 (and elements thereof) may further include nylon, woven nylon, elastane, UHMWPE crossply, UHMWPE ripstop, UHMWPE woven, and the like.

In various embodiments, the removable frame may be comprised of, for example, a metal, such as aluminum, steel, brass, nickel, copper and the like. In various embodiments, the removable frame may be an aluminum tubing ranging in diameter between 1 millimeter (mm)-3 mm, 3-5 mm, 5-7 mm, 7-9 mm, 9-15 mm, and 15-20 mm. In various embodiments, the removable frame may be an aluminum tubing having a diameter of 7 mm.

In various embodiments, the backpack 200 may comprise an interior storage compartment 211 volume of between 20 liters (L)-30 L, 30 L-40 L, 40 L-50 L, 50 L-60, and 60 L-70 L. In various embodiments, the backpack 100 may comprise an interior storage compartment 211 volume of, for example, 40 L. In various embodiments, the backpack 100 may comprise an interior storage compartment 211 volume of, for example 40 L, expandable to 50 L.

In various embodiments, the back wall 206 of the pack body 204, as measured between the basal region 212*b* to the upper region 212*a* of the perimeter wall 210 may range in length between 10 inches (in)-14 in, 14 in-18 in, 18 in-22 in, 22-26 in, 26 in-30 in, and 30 in-34 in. In various embodiments, the front wall 208 and each of the lateral walls 240/244 of the perimeter wall 210 may have the same or substantially equivalent length as the back wall 206. In various embodiments, the upper region 212*a* and the basal region 212*b*, as measured between the first lateral wall 240 and second lateral wall 244 of the perimeter wall 210 may range in width between 8 inches (in)-9.5 in, 9.5 in-11 in, 11 in-12.5 in, 12.5 in-14.5 in, 14.5 in-16.5 in, and 16.5 in-18.5 in. In various embodiments, the upper region 212*a* and basal region 212*b* may each be 12.5 in wide. In various embodiments, the upper region 212*a* and basal region 212*b* may have the same widths. In other embodiments, the upper region 212*a* and basal region 212*b* may have different widths. The various zippers of the backpack 200 may be configured into any size relative to the length and/or width of the walls of the pack body 204 (e.g., the back wall 206, front wall 208, and the walls and regions of the perimeter wall 210: the upper region 212*a*, basal region 212*b*, first lateral wall 240, second lateral wall 244). For instance, the size of the zippers may be ratios of length and/or width relative to the length and/or width of the walls of the pack body, ranging from 1-20 percent (%), 20-40%, 40-60%, 60-80%, and/or 80-100% of the length and/or width of the walls of the pack body 204.

The above is presented to describe specific attributes of this invention. The inventor has contemplated that the backpack and ultralight backcountry backpack of the present disclosure could be used for any purpose, be it day-to-day activity or any outdoor or backcountry activity. The inventor has also contemplated that the backpack and ultralight backcountry backpack of the present disclosure could be used by all kinds of users, be they day-to-day users, recreational snowboarders, daring explorers, and the like. This description is not meant to limit the scope of this disclosure.

The invention will be especially pertinent to those who benefit from backpacks with storage apparatus' that enable quick, efficient, neat, and convenient access to whatever contents may be stored in the backpack, without the need to doff and don the backpack or otherwise disturb the rest of the backpack's contents. The backpack and ultralight backcountry backpack of the present disclosure may be beneficial to users who may need (or may conveniently want) stored contents and/or their most important contents at a moment's notice. The backpack and ultralight backcountry backpack of the present disclosure may also be beneficial to users who do not want to get the backpack (or its other contents) wet and/or dirty unnecessarily, and who want to avoid the arduous task of repeatedly rearranging the contents within the backpack, saving time, energy, and in some cases where damage from the elements is prevented, money.

The preceding detailed description is merely illustrative in nature and is not intended to limit the embodiments of the subject matter or the application and uses of such embodiments.

As used herein, the words "various" and "exemplary" means "serving as an example, instance, or illustration." Any implementation described herein as various or exemplary is not necessarily to be construed as preferred or advantageous over other implementations. Furthermore, there is no intention to be bound by any expressed or implied theory presented in the preceding technical field, background, or detailed description.

The connecting lines shown in the various figures contained herein are intended to represent exemplary functional relationships and/or physical couplings between the various elements. It should be noted that many alternative or additional functional relationships or physical connections may be present in an embodiment of the subject matter. In addition, certain terminology may also be used herein for the purpose of reference only, and thus are not intended to be limiting, and the terms "first", "second" and other such numerical terms referring to structures do not imply a sequence or order unless clearly indicated by the context.

The foregoing description refers to elements or features being "connected" or "coupled" together. As used herein, "connected" and "coupled" are used interchangeably. As used herein, unless expressly stated otherwise, "connected" and "coupled" means that one element is directly or indirectly joined to (or directly or indirectly communicates with, electrically or otherwise) another element, and not necessarily mechanically. Thus, although the backpacks shown in the figures depict exemplary arrangements of elements, additional intervening elements, devices, features, or components may be present in an embodiment of the depicted subject matter.

While at least one exemplary embodiment has been presented in the foregoing detailed description, it should be appreciated that a vast number of variations exist. It should also be appreciated that the exemplary embodiment or various embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. An ultralight backcountry backpack, comprising:

at least one shoulder strap connected to a pack body, said pack body comprising:

a back wall configured to interface with a user's back when the backpack is worn, said back wall including a back wall zipper;

a front wall distal to the back wall; and a perimeter wall connecting the back and front walls, said perimeter wall including an upper region and a basal region, wherein the basal region comprises a probe zipper, a shovel blade zipper, and a shovel rod zipper, wherein the back, front, and perimeter walls define an interior storage compartment; and a tool storage apparatus within the interior storage compartment, the apparatus comprising:

a probe sleeve;

a shovel blade sleeve; and a shovel rod sleeve, wherein each of the probe, shovel blade, and shovel rod sleeves is configured to be accessible at the basal region by opening and closing corresponding probe, shovel blade, and shovel rod zippers, wherein each of the probe zipper, shovel blade zipper, and shovel rod zipper allows a user to access the tool storage apparatus without taking off the backpack.

2. The backpack of claim 1, wherein the at least one shoulder strap is connected to the pack body at the back wall.

3. The backpack of claim 2, wherein the at least one shoulder strap comprises at least one adjustable load lifter strap proximal the upper region of the pack body, wherein the at least one adjustable load lifter strap is configured to further connect the at least one shoulder strap to the back wall.

4. The backpack of claim 1, wherein the back wall comprises an interior surface defining a back panel pocket, wherein the back panel pocket is configured to receive a removable back panel sheet.

5. The backpack of claim 4, wherein the removable back panel sheet is a polyethylene foam sheet.

6. The backpack of claim 1, wherein the back wall defines at least one port proximal the upper region of the pack body, wherein the at least one port is configured to allow access to at least one of an air-supply mouthpiece and a hydration tube mouthpiece.

7. The backpack of claim 1, wherein the front wall defines at least one ice tool pocket configured to receive an ice tool pick, and wherein the front wall further comprises at least one buckle configured to secure an ice tool pick in the at least one ice tool pocket.

8. The backpack of claim 1, wherein the pack body further comprises a diagonal ski carry system, said system comprising:

a loop attached at the front wall proximal the basal region; and a strap diagonally distal the loop and attached to the upper region of the perimeter wall, said strap being configured to removably couple to a hoop at the back wall proximal the upper region, wherein the diagonal ski carry system is configured to removably secure skis to the backpack.

9. The backpack of claim 1, wherein the pack body further comprises a removable frame within the interior storage compartment, wherein the removable frame extends along the perimeter wall.

10. The backpack of claim 1, wherein the pack body further comprises at least one hip pad, wherein the at least one hip pad is a removable slide-on hip pad.

11. The backpack of claim 1, wherein the probe sleeve is defined by (i) an interior surface of a first lateral region of the perimeter wall and (ii) an interior surface of the basal region.

12. The backpack of claim 1, wherein the shovel rod sleeve is defined by (i) an interior surface of a second lateral region of the perimeter wall and (ii) the interior surface of the basal region.

13. The backpack of claim 1, wherein the shovel blade sleeve is defined by (i) an interior surface of the front wall and (ii) the interior surface of the basal region.

14. The backpack of claim 1, wherein the upper region of the perimeter wall defines an expandable cinch opening.

15. A backpack, comprising:

at least one shoulder strap connected to a pack body, said pack body comprising:

a first wall configured to interface with a user's back when the backpack is worn, said first wall including a wall zipper;

a second wall distal to the first wall; and a third wall connecting the first and second walls, said third wall including:

an upper region;

a basal region;

a first lateral region; and a second lateral region, a first lateral region zipper located proximately between the basal region and first lateral region;

a base zipper located proximately between the second wall and the basal region of the third wall;

wherein the pack body defines an interior volume and wherein interior surfaces of the first, second, and third walls define a storage apparatus within the interior volume, wherein each of the first lateral region zipper and base zipper allows a user to access the storage apparatus without taking off the backpack.

16. A backpack, comprising:

at least one shoulder strap connected to a pack body, said pack body comprising:

a first wall configured to interface with a user's back when the backpack is worn, said first wall including a wall zipper;

a second wall distal to the first wall; and a third wall connecting the first and second walls, said third wall including an upper region and a basal region, wherein the basal region comprises a first zipper, a second zipper, and a third zipper, wherein the first, second, and third walls define an interior volume; and a storage apparatus within the interior volume, the apparatus comprising:

a first sleeve;

a second sleeve; and a third sleeve, wherein each of the first, second, and third sleeves is configured to be accessible at the basal region by opening and closing corresponding first, second, and third zippers, wherein each of the first, second, and third zippers allows a user to access the storage apparatus without taking off the backpack.

17. The backpack of claim 16, wherein the at least one shoulder strap is connected to the pack body at the first wall.

18. The backpack of claim 16, wherein the pack body further comprises a vertical snowboard carry system, said system comprising:

a first strap attached at the second wall proximal the basal region, the first strap further comprising a clasp configured to removably couple to a corresponding buckle attached at the second wall proximal the basal region; and a second strap diagonally distal the first strap and attached at the upper region of the third wall, the second strap being configured to removably couple to a band attached at the first wall proximal the upper region, wherein the vertical snowboard carry system is configured to removably secure a snowboard to the backpack.

19. The backpack of claim 16, wherein the pack body further comprises a removable frame within the interior volume, wherein the removable frame extends along the third wall.

20. The backpack of claim 16, wherein the first sleeve is defined by (i) an interior surface of a first lateral region of the third wall and (ii) an interior surface of the basal region, wherein the second sleeve is defined by an interior surface of the second wall and (ii) the interior surface of the basal region, and wherein the third sleeve is defined by (i) an interior surface of a second lateral region of the third wall and (ii) the interior surface of the basal region.

* * * * *